US007140223B2

(12) United States Patent
Chupak

(10) Patent No.: US 7,140,223 B2
(45) Date of Patent: Nov. 28, 2006

(54) METHOD OF PRODUCING ALUMINUM CONTAINER FROM COIL FEEDSTOCK

(75) Inventor: Thomas Chupak, West Middlesex, PA (US)

(73) Assignee: Exal Corporation, Youngstown, OH (US)

( * ) Notice: Subject to any disclaimer, the term of this patent is extended or adjusted under 35 U.S.C. 154(b) by 0 days.

(21) Appl. No.: 11/151,385

(22) Filed: Jun. 13, 2005

(65) Prior Publication Data

US 2005/0235726 A1 Oct. 27, 2005

Related U.S. Application Data

(63) Continuation of application No. 10/224,256, filed on Aug. 20, 2002, now abandoned.

(51) Int. Cl.
*B21D 41/04* (2006.01)

(52) U.S. Cl. ..... 72/356; 72/379.4; 413/69

(58) Field of Classification Search ..... 72/348, 72/356, 379.4; 220/604; 413/69
See application file for complete search history.

(56) References Cited

U.S. PATENT DOCUMENTS 4,414,836 A 11/1983 Saunders
4,774,839 A 10/1988 Caleffi et al.
4,826,382 A 5/1989 Bulso, Jr. et al.
5,024,077 A 6/1991 Bulso, Jr. et al.
5,249,447 A * 10/1993 Aizawa et al. ..... 72/46
5,394,727 A 3/1995 Diekhoff et al.
5,487,295 A 1/1996 Diekhoff et al.
5,497,900 A 3/1996 Caleffi et al.
5,522,248 A 6/1996 Diekhoff et al.
5,572,893 A 11/1996 Goda et al.
5,630,337 A 5/1997 Werth
5,713,235 A 2/1998 Diekhoff
5,718,352 A 2/1998 Diekhoff et al.
5,740,692 A 4/1998 Dunwoody
5,778,722 A 7/1998 Saiki et al.
5,778,723 A 7/1998 Diekhoff
5,881,593 A 3/1999 Bulso, Jr. et al.
5,946,964 A 9/1999 Snyder et al.
6,010,026 A 1/2000 Diekhoff et al.
6,010,028 A 1/2000 Jordan et al.
6,038,910 A 3/2000 McClung
6,094,961 A 8/2000 Aschberger
6,095,378 A 8/2000 Potts et al.

FOREIGN PATENT DOCUMENTS

WO WO 02/060615 A2 1/2002

* cited by examiner

*Primary Examiner*—Lowell A. Larson
(74) *Attorney, Agent, or Firm*—Thorp, Reed & Armstrong LLP

(57) ABSTRACT

Aerosol cans, more particularly, aluminum aerosol cans made from disks of aluminum coil feedstock, are provided. A method for necking aerosol cans of a series 3000 aluminum alloy is also provided. The method prevents the cans from sticking in the necking dies and produces a can with a uniquely shaped profile. The aluminum aerosol cans that are produced have the attributes of strength and quality, while being produced at a cost that is competitive with steel aerosol cans.

24 Claims, 47 Drawing Sheets

| NO. | ØA | B |
|---|---|---|
| 1 | 50.92 | 97 |
| 2 | 49.86 | 97 |
| 3 | 49.33 | 97 |
| 4 | 48.58 | 97 |
| 5 | 48.06 | 97 |
| 6 | 47.27 | 97 |
| 7 | 46.03 | 97 |
| 8 | 44.87 | 97 |
| 9 | 43.72 | 97 |
| 10 | 42.58 | 97 |
| 11 | 41.50 | 97 |
| 12 | 40.41 | 97 |
| 13 | 39.35 | 97 |
| 14 | 38.33 | 97 |

| NO. | ØA | ØB | C |
|---|---|---|---|
| 15 | 37.85 | 37.35 | 51.00 |
| 16 | 36.89 | 36.39 | 51.12 |
| 17 | 35.97 | 35.46 | 52.00 |
| 18 | 35.02 | 34.50 | 52.70 |
| 19 | 34.16 | 33.61 | 53.00 |
| 20 | 33.26 | 32.72 | 54.32 |
| 21 | 32.45 | 31.87 | 55.00 |
| 22 | 31.60 | 31.03 | 55.88 |
| 23 | 30.88 | 30.30 | 56.00 |
| 24 | 30.18 | 29.58 | 57.26 |
| 25 | 29.56 | 28.96 | 57.00 |
| 26 | 28.96 | 28.34 | 58.35 |
| 27 | 28.46 | 27.82 | 58.50 |
| 28 | 27.93 | 27.30 | 58.95 |
| 29 | 27.53 | 26.87 | 59.50 |
| 30 | 27.09 | 26.44 | 59.45 |
| 31 | 26.81 | 26.15 | 59.50 |
| 32 | 26.55 | 25.88 | 59.80 |
| 33 | 26.32 | 25.64 | 59.70 |
| 34 | 26.10 | 25.42 | 59.82 |

METHOD OF PRODUCING ALUMINUM CONTAINER FROM COIL FEEDSTOCK

This application is a continuation of U.S. application Ser. No. 10/224,256 entitled Aluminum Aerosol Can and Aluminum Bottle and Method of Manufacture filed Aug. 20, 2002, now abandoned.

BACKGROUND OF THE INVENTION

1. Field of the Invention

The present invention is directed to aerosol cans and, more particularly, to aerosol cans constructed of aluminum.

2. Description of the Background

Traditionally, beverage cans begin as disks of aluminum coil feedstock that are processed into the shape of a beverage can. The sides of these cans are approximately 0.13 mm thick. Generally, the body of a beverage can, excluding the top, is one piece.

In contrast, aerosol cans are traditionally made one of two ways. First, they can be made from three pieces of steel, a top piece, a bottom piece, and a cylindrical sidewall having a weld seem running the length of the sidewall. These three pieces are assembled to form the can. Aerosol cans may also be made from a process known as impact extrusion. In an impact extrusion process, a hydraulic ram punches an aluminum slug to begin forming the can. The sides of the can are thinned to approximately 0.40 mm through an ironing process that lengthens the walls of the can. The rough edges of the wall are trimmed and the can is passed through a series of necking dies to form the top of the can. Although aerosol cans made of steel are less expensive than aerosol cans made by an impact extrusion process, steel cans are aesthetically much less desirable than aerosol cans made with an impact extrusion process.

For a variety of reasons, aluminum aerosol cans are significantly more expensive to produce than aluminum beverage cans. First, more aluminum is used in an aerosol can than in a beverage can. Second, the production of aluminum cans by impact extrusion is limited by the maximum speed of the hydraulic ram of the press. Theoretically, the maximum speed of the ram is 200 strokes/minute. Practically, the speed is 180 slugs/minute. Beverage cans are made at a rate of 2,400 cans/minute.

One problem facing the aerosol can industry is producing an aluminum aerosol can that performs as well or better than traditional aerosol cans but is economically competitive with the cost of producing steel aerosol cans and aluminum beverage cans. Another problem is producing an aerosol can that has the printing and design quality demanded by designers of high-end products. Traditional beverage cans are limited in the clarity of printing and design that can be imprinted on the cans. Beverage cans are also limited in the number of colors that can be used in can designs. Thus, a need exits for an aluminum aerosol can that has the attributes of strength and quality, while being produced at a cost that is competitive with steel aerosol cans.

Producing aluminum cans of a series 3000 aluminum alloy coil feedstock solves some of these problems. Series 3000 aluminum alloy coil feedstock can be shaped into a can using a reverse draw and ironing process, which is significantly faster and more cost effective than impact extrusion, aluminum can production. Additionally, series 3000 aluminum alloy is less expensive, more cost effective, and allows for better quality printing and graphics than the use of pure aluminum.

Unfortunately, certain obstacles arise in necking a series 3000 aluminum alloy can. Series 3000 aluminum alloy is a harder material than pure aluminum. Therefore, cans made from series 3000 aluminum alloy are stiffer and have more memory. This is advantageous because the cans are more dent resistant, but it poses problems in necking the cans by traditional means because the cans stick in traditional necking dies and jam traditional necking machines. The solution to these obstacles is embodied in the method of the present invention.

SUMMARY OF THE PRESENT INVENTION

This invention relates to a method for making and necking an aluminum aerosol can from a disk of aluminum alloy coil feedstock where the method is designed to, among other things, prevent the can from sticking in the necking dies. Additionally, this invention relates to the aluminum aerosol can itself, which has a uniquely shaped profile and is made from aluminum alloy of the 3000 series.

The aluminum can of the present invention is comprised of a generally vertical wall portion having an upper end and a lower end, where the upper end has a predetermined profile. A bottom portion, extending from the lower end of the can, has a U-shaped profile around its periphery and a dome-shaped profile along the remainder of the bottom portion. Preferably, the generally vertical wall portion is approximately 0.20 mm thick, and the bottom portion is approximately 0.51 mm thick in the area of the U-shaped profile.

The present invention is also directed to a method of forming a neck profile in an aluminum can made of a series 3000 aluminum alloy, where the can is processed with at least 30 different necking dies. This invention solves the problems of necking a series 3000 aluminum alloy can by increasing the number of necking dies used and decreasing the degree of deformation that is imparted with each die. A traditional aerosol can, made from pure aluminum, which is 45 mm to 66 mm in diameter, requires the use of 17 or less necking dies. A can made by the present invention, of similar diameters, made from a series 3000 aluminum alloy requires the use of, for example, thirty or more necking dies. Generally, the number of dies that are needed to neck a can of the present invention depends on the profile of the can. The present invention processes the aluminum can sequentially through a sufficient number of necking dies so as to effect the maximum incremental radial deformation of the can in each necking die while ensuring that the can remains easily removable from each necking die.

There are several advantages of the can and method of the present invention. Overall, the process is faster, less expensive, and more efficient than the traditional method of impact extrusion, aerosol can production. The disclosed method of production uses a less expensive, recyclable aluminum alloy instead of pure aluminum. The disclosed can is more desirable than a steel can for a variety of reasons. Aluminum is resistant to moisture and does not corrode or rust. Furthermore, because of the shoulder configuration of a steel can, the cap configuration is always the same and cannot be varied to give customers an individualized look. This is not so with the present invention in which the can shoulder may be customized. Finally, aluminum cans are aesthetically more desirable. For example, the cans may be brushed and/or a threaded neck may be formed in the top of the can. Those advantages and benefits and others, will be apparent from the Description of the Preferred Embodiments within.

BRIEF DESCRIPTION OF THE DRAWINGS

For the present invention to be easily understood and readily practiced, the present invention will now be described, for purposes of illustration and not limitation, in conjunction with the following figures, wherein.

DESCRIPTION OF THE PREFERRED EMBODIMENTS

For ease of description and illustration, the invention will be described with respect to making and necking a drawn and ironed aluminum aerosol can, but it is understood that its application is not limited to such a can. The present invention may also be applied to a method of necking other types of aluminum, aluminum bottles, metal containers and shapes. It will also be appreciated that the phrase "aerosol can" is used throughout for convenience to mean not only cans, but also aerosol bottles, aerosol containers, non-aerosol bottles, and non-aerosol containers.

The present invention is an aerosol can and a method for making aluminum alloy cans that perform as well or better than traditional aluminum cans, that allow for high quality printing and design on the cans, that have customized shapes, and that are cost competitive with production of traditional aluminum beverage cans and other steel aerosol cans. The target markets for these cans are, among others, the personal care, energy drinks, and pharmaceutical markets.

Figure 1:
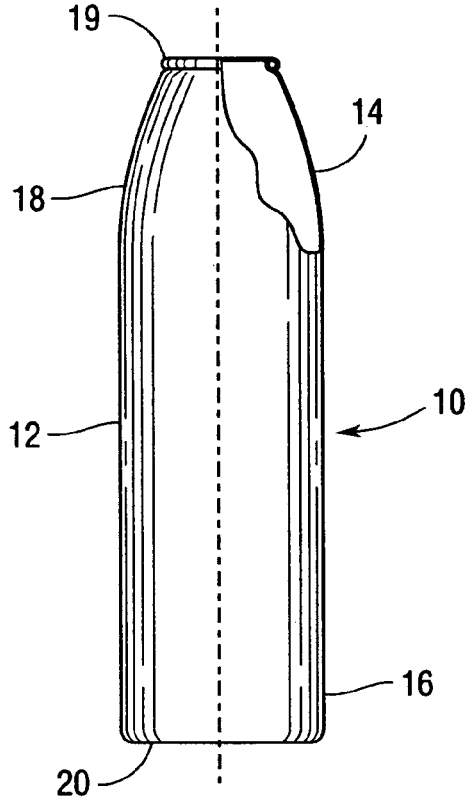
FIG. 1 is a view of one example of an aluminum can formed by the method of the present invention, partially in cross-section.
Figure 2:
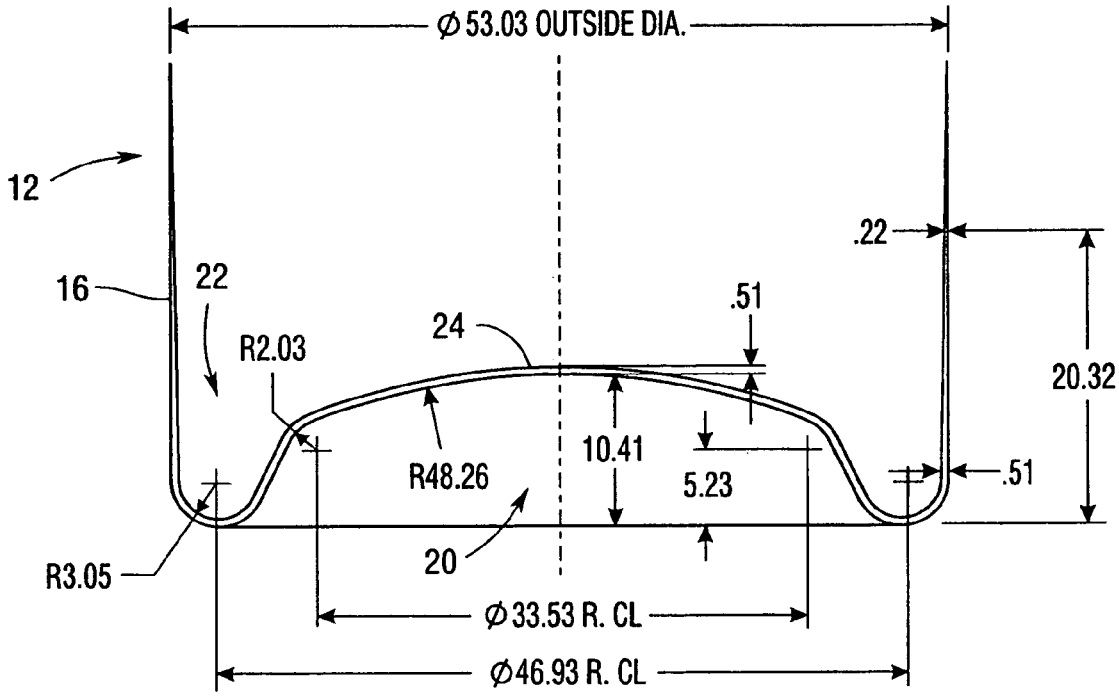
FIG. 2 is a cross-sectional view of the bottom portion of the aluminum can of FIG. 1.
Figure 52:
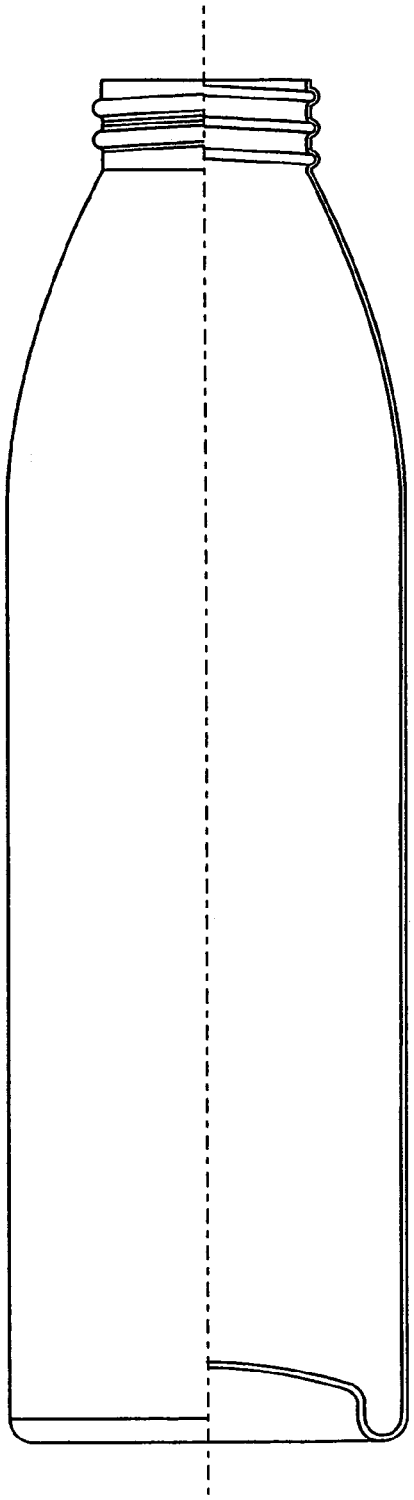
FIG. 52 shows an aluminum can of the present invention having a threaded aluminum neck, partially in cross-section.

A one piece, aluminum aerosol can 10, as seen in FIG. 1, has a generally vertical wall portion 12. The generally vertical wall portion 12 is comprised of an upper end 14 and a lower end 16. The upper end 14 has a predetermined profile 18, and a neck 19 that has been curled. Alternatively, the neck can be threaded (see FIGS. 52 and 53). The aluminum can 10 also has a bottom portion 20 extending from the lower end 16. As shown in FIG. 2, the bottom portion 20 has a U-shaped profile 22 around the periphery of the bottom portion 20 and a wrinkle-free, dome-shaped profile 24 along the remainder of the bottom portion 20. The U-shaped profile 22 is preferably 0.51 mm thick.

Figure 3:
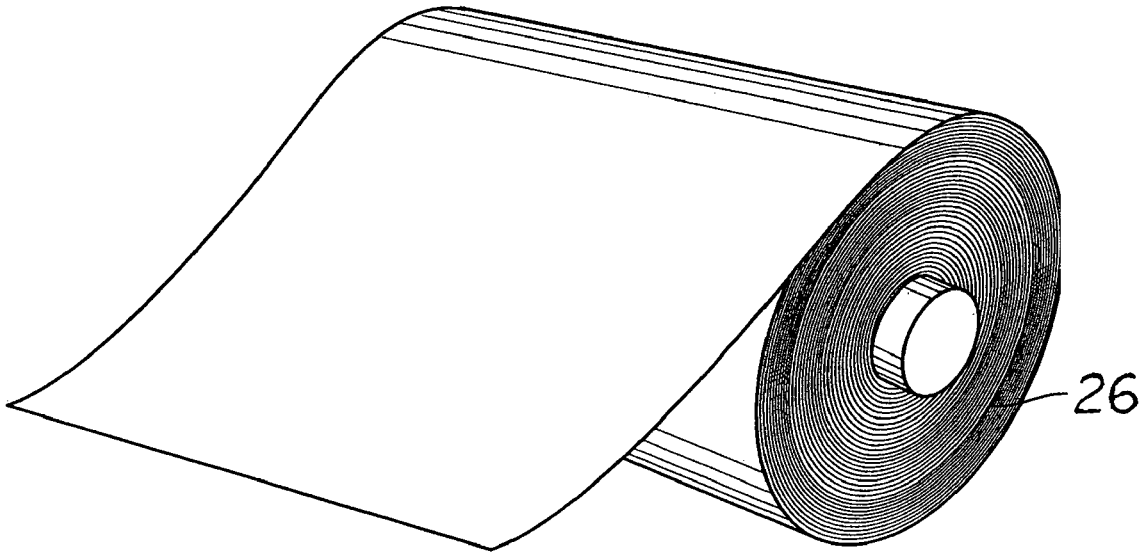
FIG. 3 is one example of a coil of aluminum alloy feedstock used for this invention.

The aluminum can 10 of the present invention is made from aluminum alloy coil feedstock 26 as shown in FIG. 3. As is known, aluminum alloy coil feedstock 26 is available in a variety of widths. It is desirable to design the production line of the present invention to use one of the commercially available widths to eliminate the need for costly slitting processes.

Figure 4:
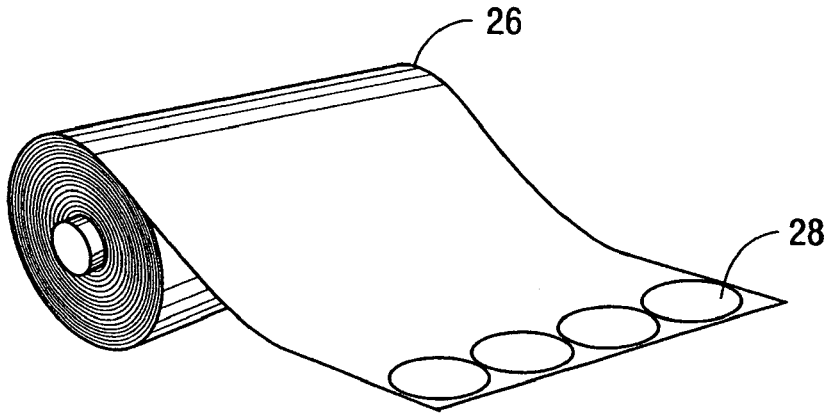
FIG. 4 is one example of the coil of aluminum alloy feedstock of FIG. 3 showing metal disks punched from it.
Figure 5:
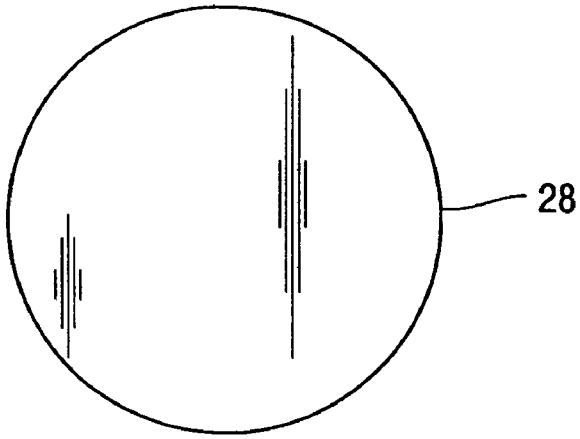
FIG. 5 is a single metal disk of FIG. 4 made of a series 3000 aluminum alloy.
Figure 6:
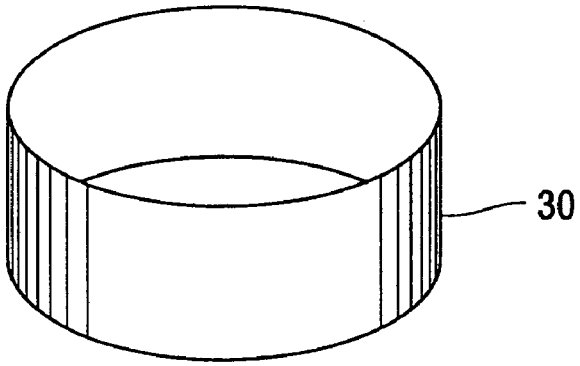
FIG. 6 illustrates the disk of FIG. 5 drawn into a cup.

The first step in a preferred embodiment of the present invention is to layout and punch disks 28 from the coil feedstock 26 as is shown in FIG. 4. It is desirable to layout the disks 28 so as to minimize the amount of unused feedstock 26. FIG. 5 shows one of the metal disk 28 punched from a series 3000 aluminum coil feedstock 26. The disk 28 is drawn into a cup 30, as shown in FIG. 6, using any of the commonly understood methods of making an aluminum cup, but preferably using a method similar to the method of U.S. Pat. Nos. 5,394,727 and 5,487,295, which are hereby incorporated by reference.

Figure 7A:
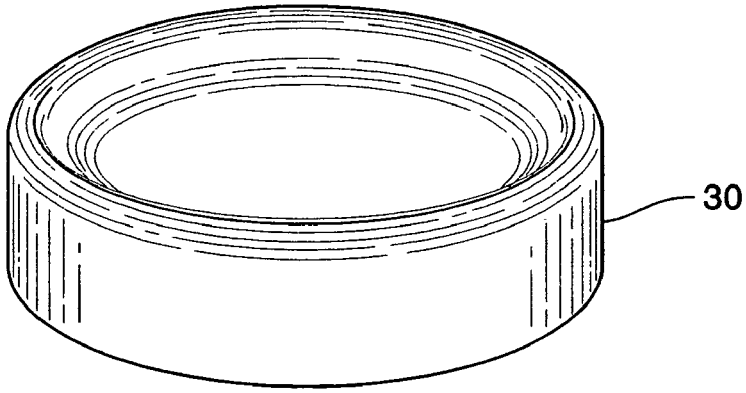
FIGS. 7A–7C illustrate the progression of the cup of FIG. 6 undergoing a reverse draw process to become a second cup having a narrower diameter after completion of the reverse draw process.
Figure 7B:
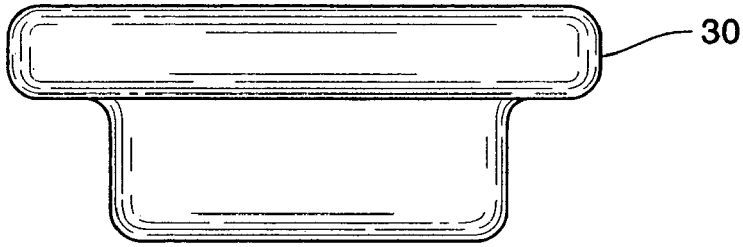
Figure 7C:
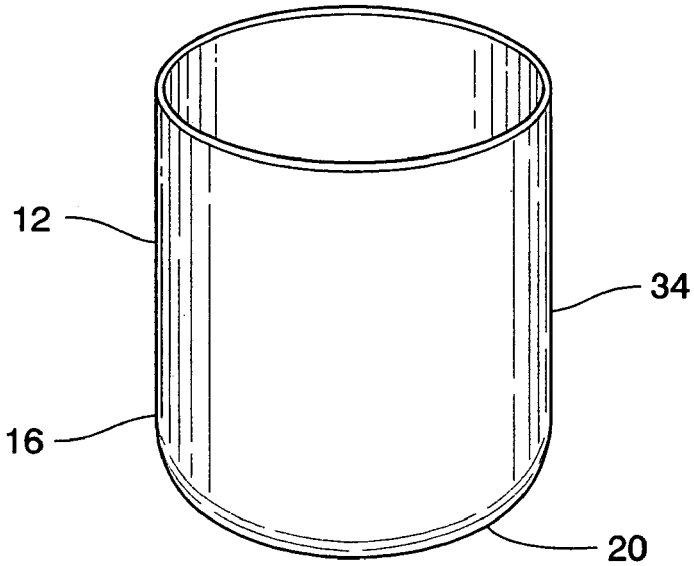
Figure 8:
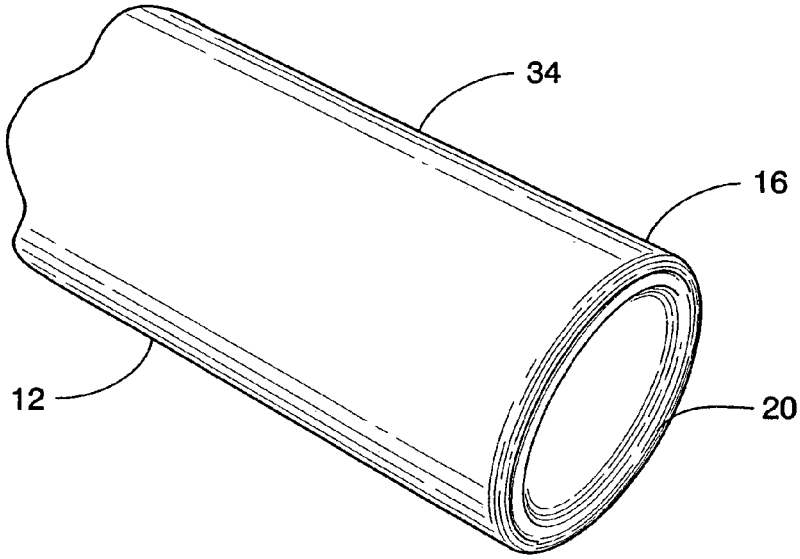
FIG. 8 illustrates one example of a shaped bottom formed in the second cup of FIG. 7C.

As shown in FIG. 7A, the cup 30 is then punched from the bottom to begin to draw the bottom of the can through the sidewalls (a reverse draw). As shown in FIG. 7B, as the stroke continues, the bottom of the cup 30 is drawn deeper so that the walls of the cup develop a lip. As shown in FIG. 7C, the completion of the stroke eliminates the lip altogether resulting in a second cup 34 that is typically narrower in diameter than the original cup 30. The second cup 34 may be drawn one or more additional times, resulting in an even narrower diameter. The resulting cup 34 has the vertical wall portion 12 and the lower end 16 with the bottom portion 20. The bottom portion 20 may be shaped as shown in FIGS. 8 and 2. Although other configurations may be used, the domed configuration illustrated herein is particularly useful for containers that are pressurized.

Figure 9A:
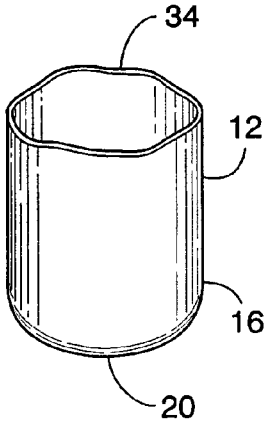
FIGS. 9A–9D illustrate the progression of the second cup of FIG. 7C or of FIG. 8 through an ironing and trimming process.
Figure 9B:
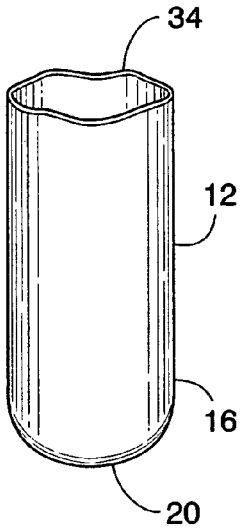
Figure 9C:
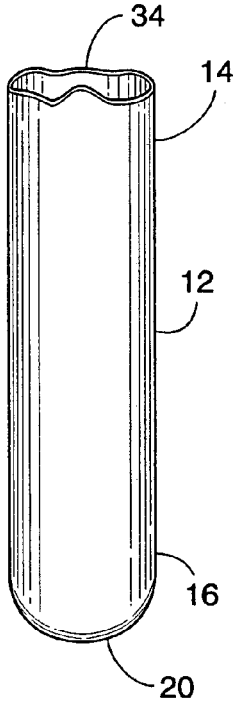
Figure 9D:
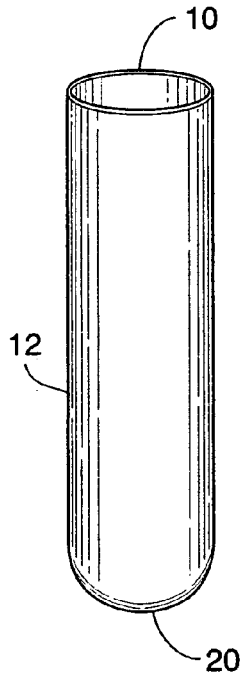

As shown in FIGS. 9A through 9D, the vertical wall portion 12 is ironed multiple times until it is of a desired height and thickness, preferably 0.21 mm thick. The vertical wall portion 12 should be of sufficient thickness to withstand the internal pressure for the intended use. For example, some aerosol products require a can that withstands an internal pressure of 270 psi or DOT 2Q. The ironing process also compacts the wall making it stronger. The upper end 14 of the vertical wall portion 12 is trimmed to produce an aluminum can 10, as shown in FIG. 9D.

Figure 10B:
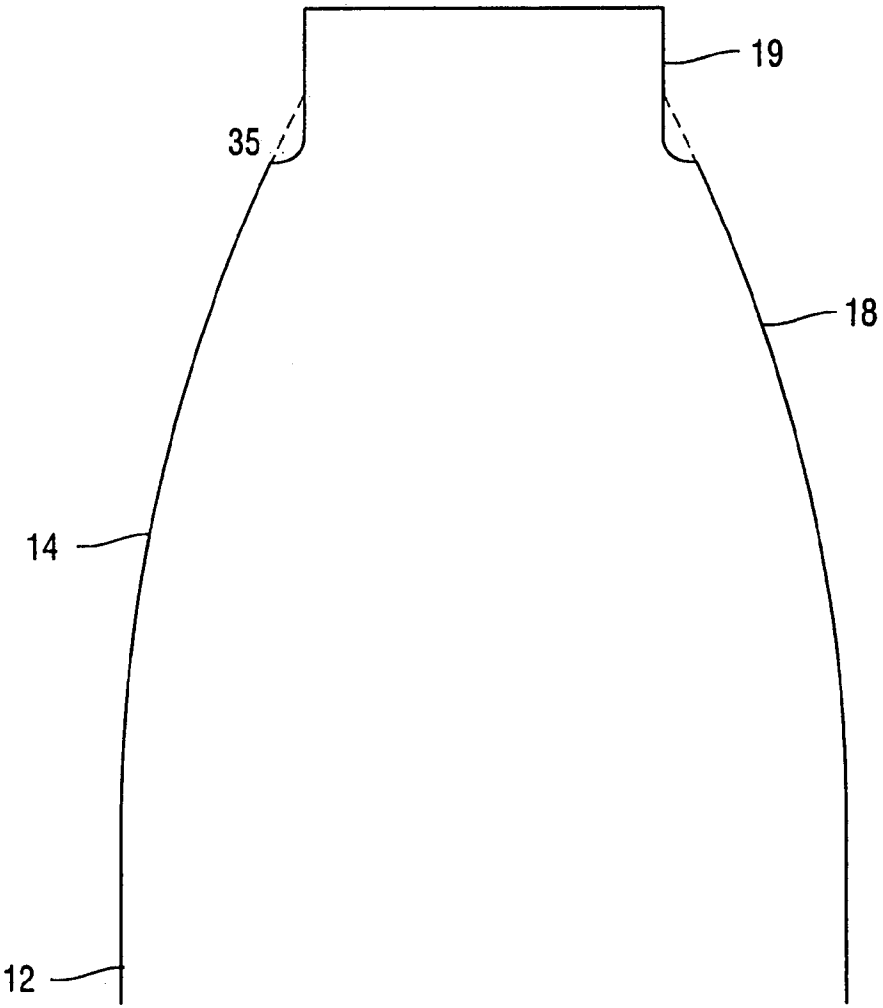
FIG. 10B illustrates the resulting shoulder of the can of FIG. 10A after it passes through the last necking die used according to one embodiment of the present invention.
Figure 10A:
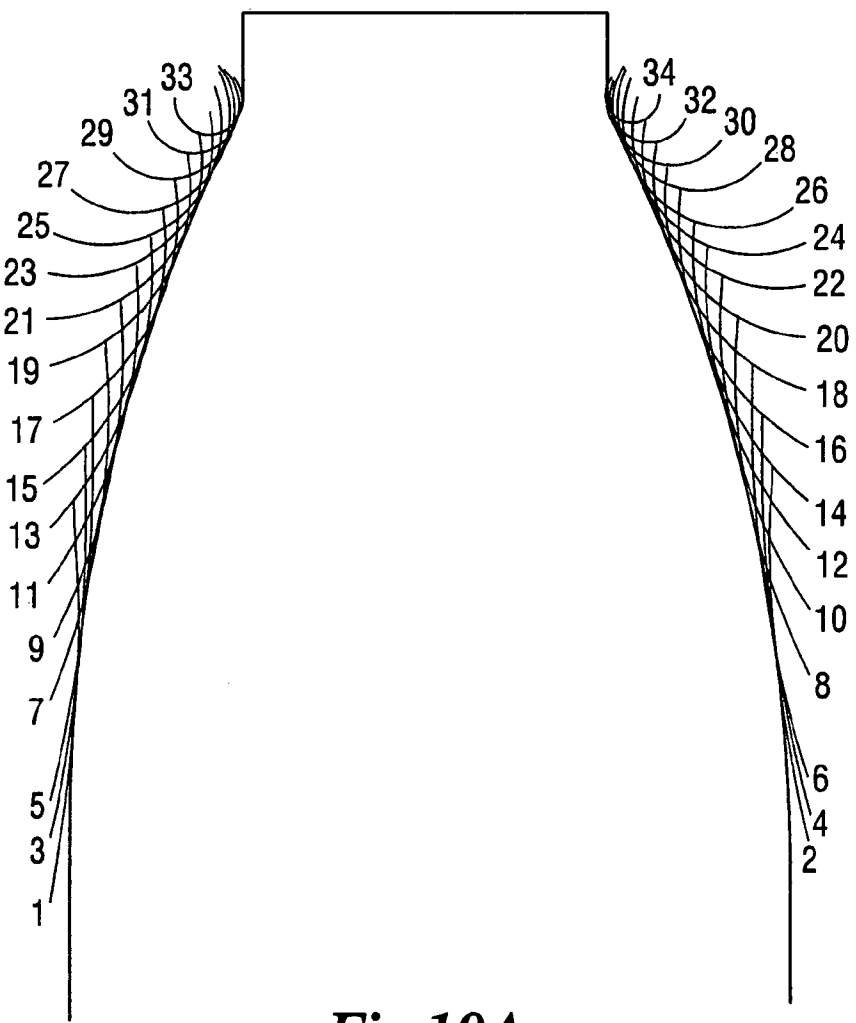
FIG. 10A shows the resulting shoulder profile of an aluminum can after the can of FIG. 9D has passed through thirty-four necking dies used according to one embodiment of the present invention.

According to one embodiment of the present invention, the can 10 is attached to a first mandrel and passed through a first series of necking dies. Subsequently, the can 10 is attached to a second mandrel and passed through a second series of necking dies. In the embodiment illustrated, the can 10 will pass through up to more than thirty necking dies. These necking dies shape the can 10 as shown in FIGS. 10A and 10B. Each die is designed to impart a desired shape to the upper end 14 of the generally vertical wall portion 12 of the can 10, so that by the end of the necking process (FIG. 10B), the upper end 14 has the desired profile 18 and the neck 19.

Figure 11D:
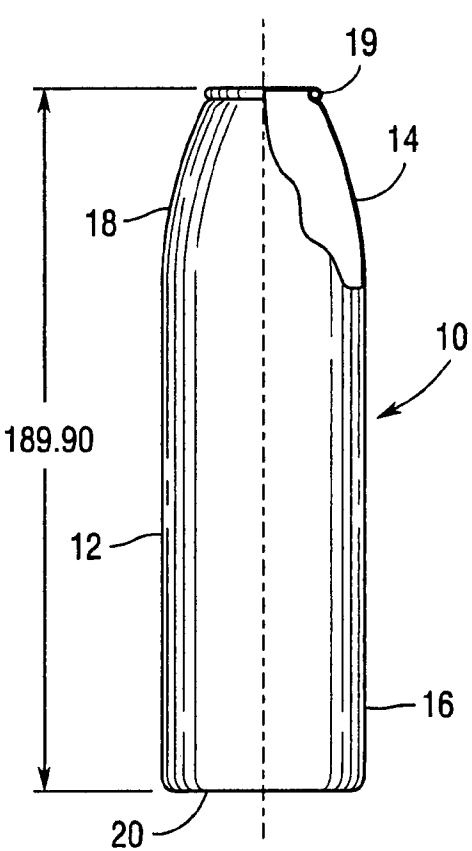
FIGS. 11A–11D are a sequence of views, partially in cross-section, of the aluminum can of FIG. 10B as it undergoes one example of a neck curling process.
Figure 11C:
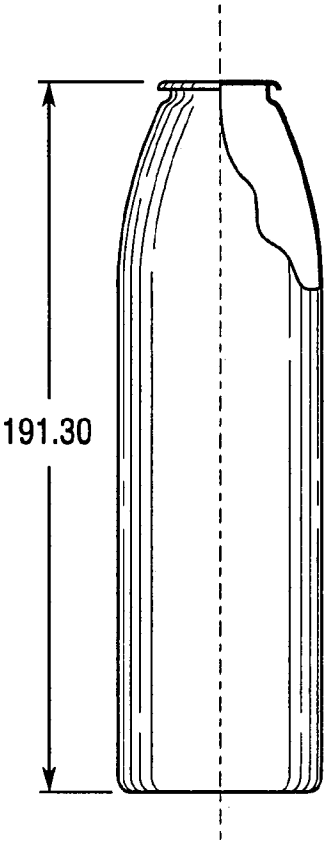
Figure 11B:
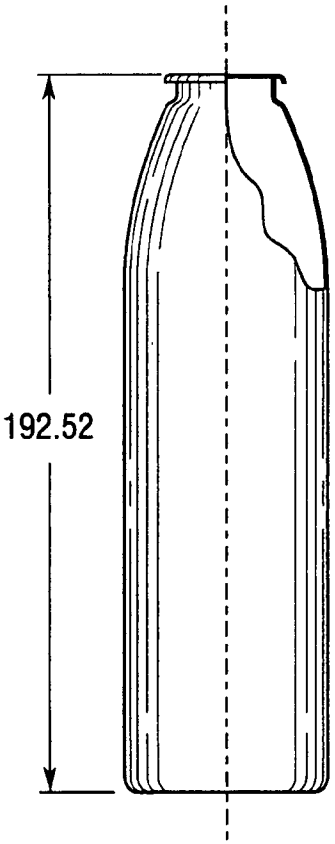
Figure 11A:
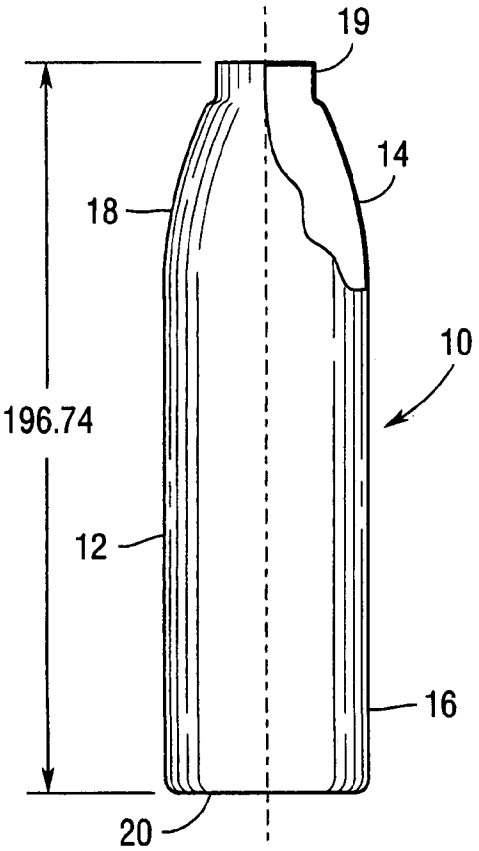
Figure 12A:
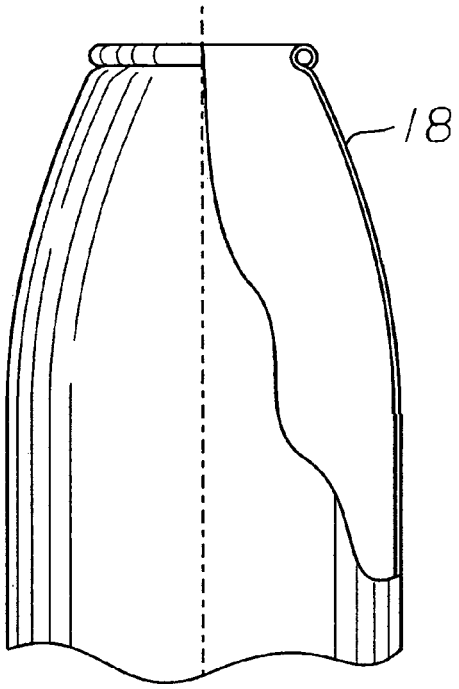
FIG. 12A is an aluminum can of FIG. 11D having a tapered shoulder.
Figure 12B:
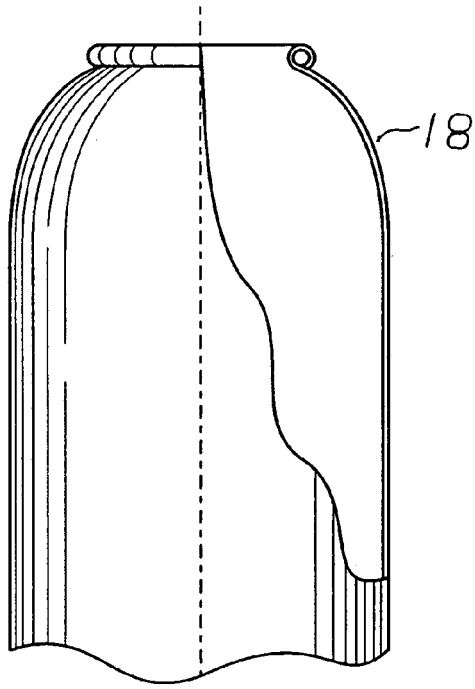
FIG. 12B is an aluminum can of FIG. 11D having a rounded shoulder.
Figure 12C:
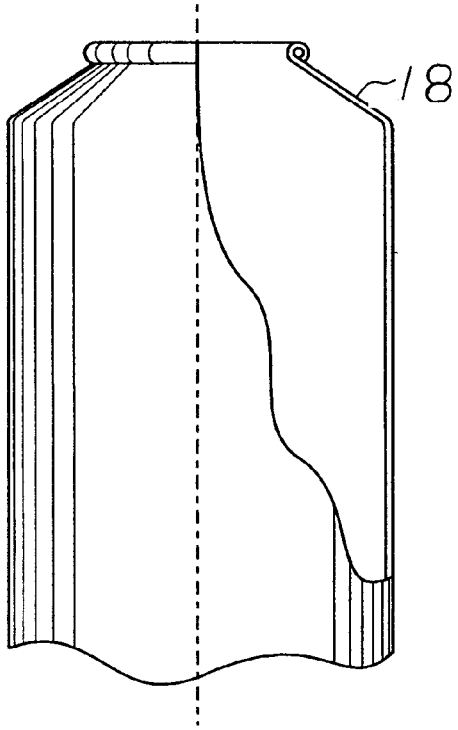
FIG. 12C is an aluminum can of FIG. 11D having a flat shoulder.
Figure 12D:
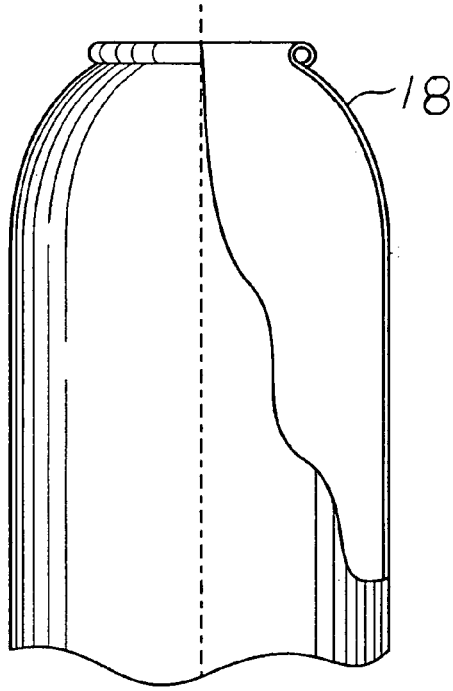
FIG. 12D is an aluminum can of FIG. 11D having an oval shoulder.
Figure 13:
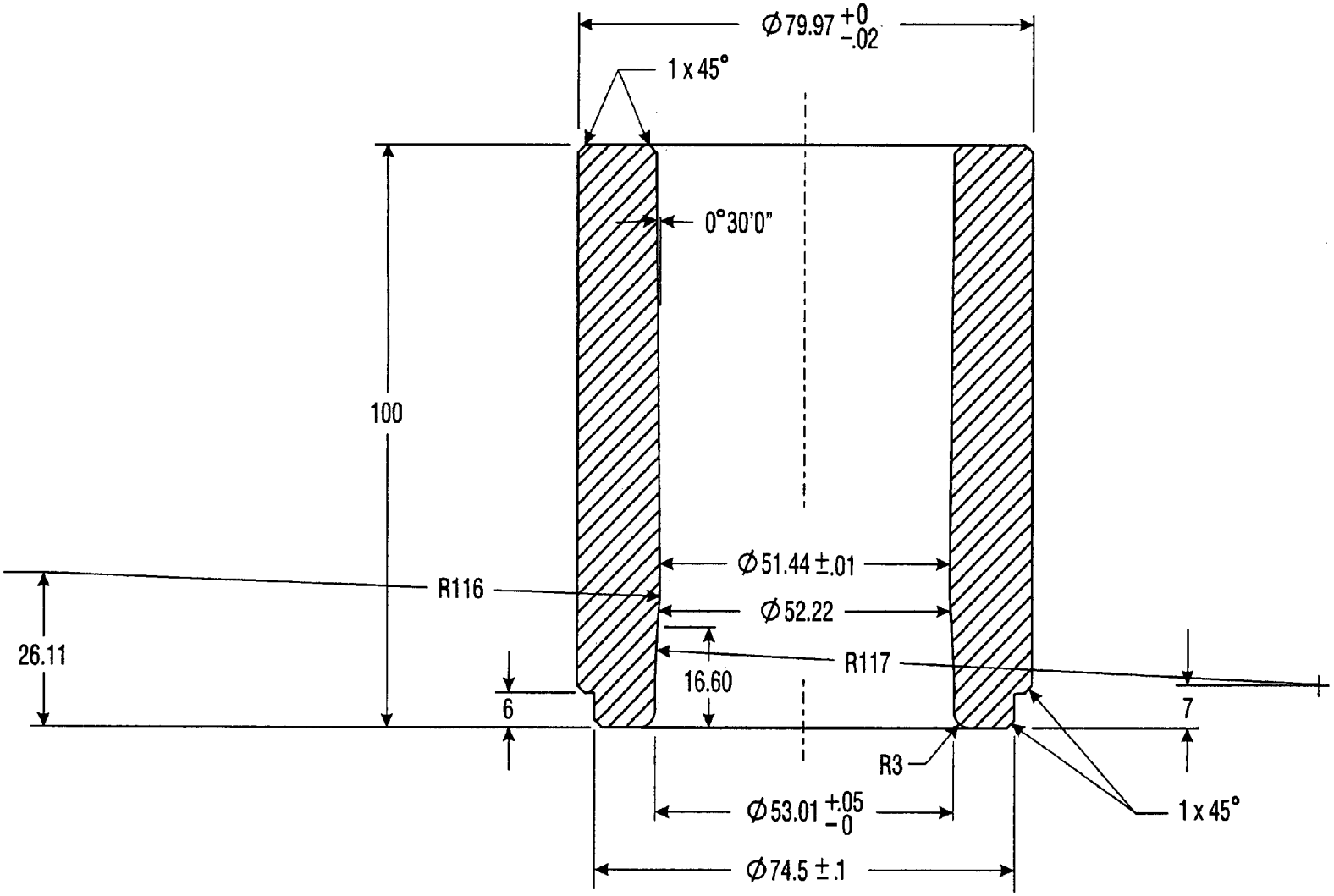
FIG. 13–FIG. 47 are a sequence of cross-sectional views illustrating thirty-five necking dies used according to one embodiment of the present invention.
Figure 14:
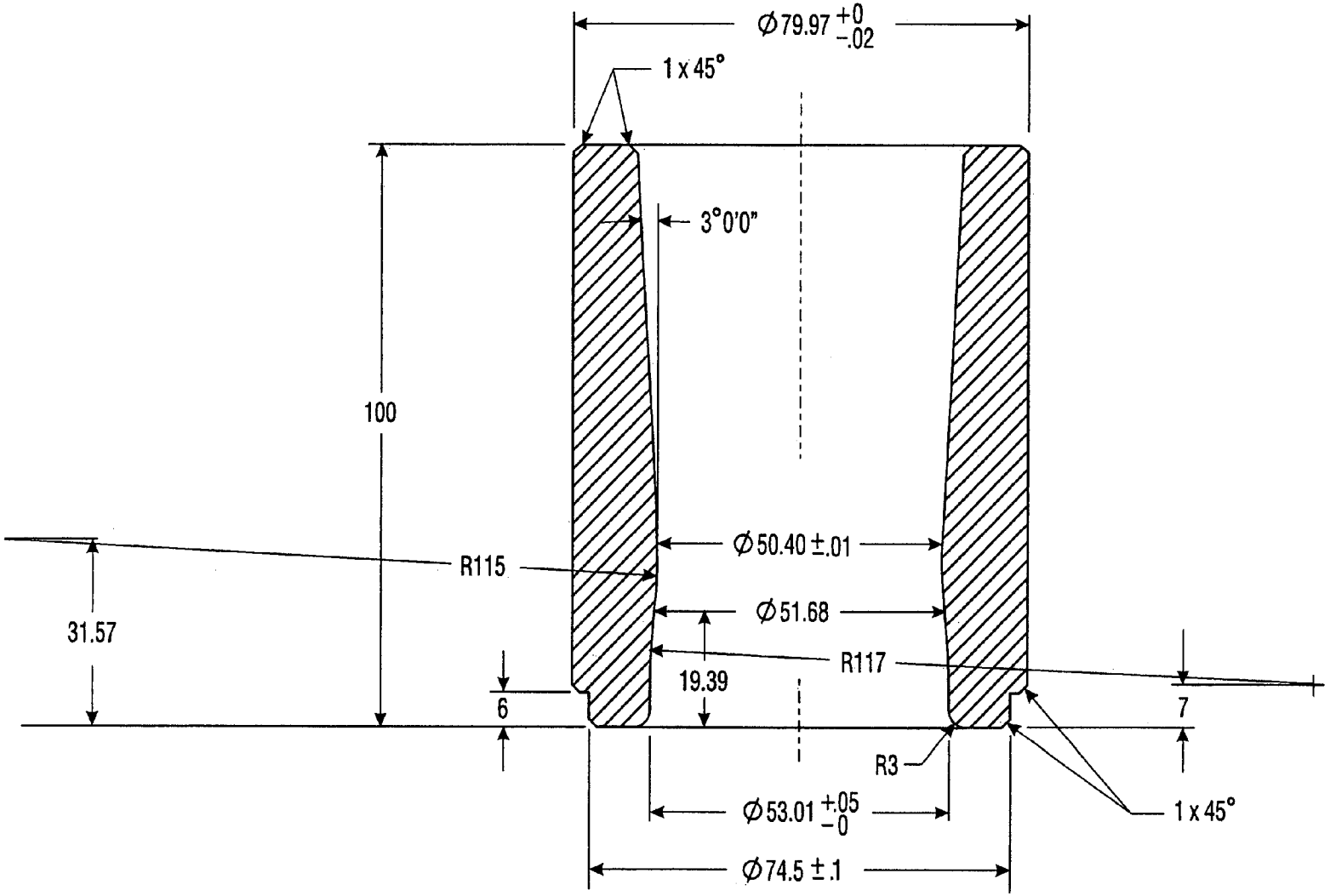
Figure 15:
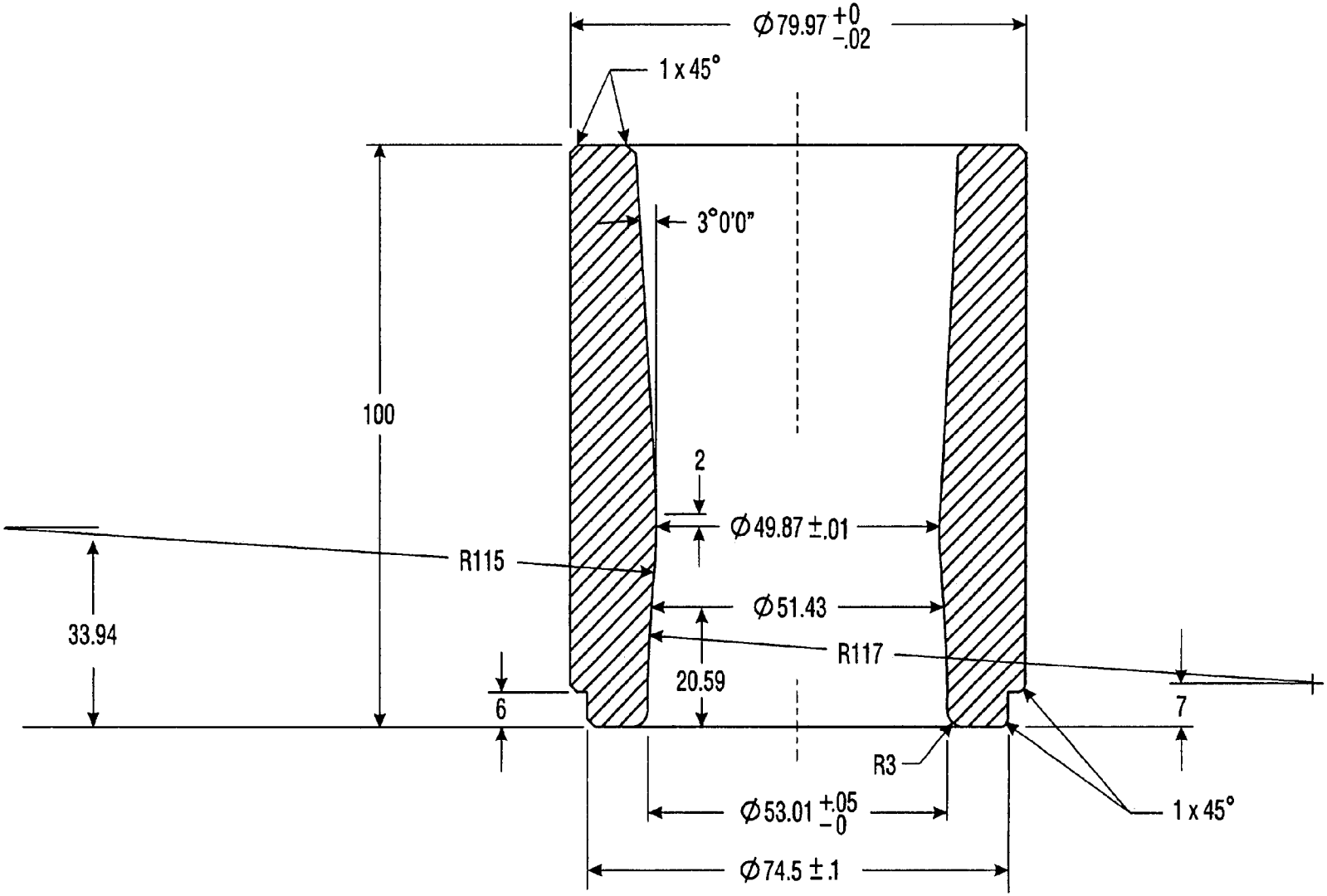
Figure 16:
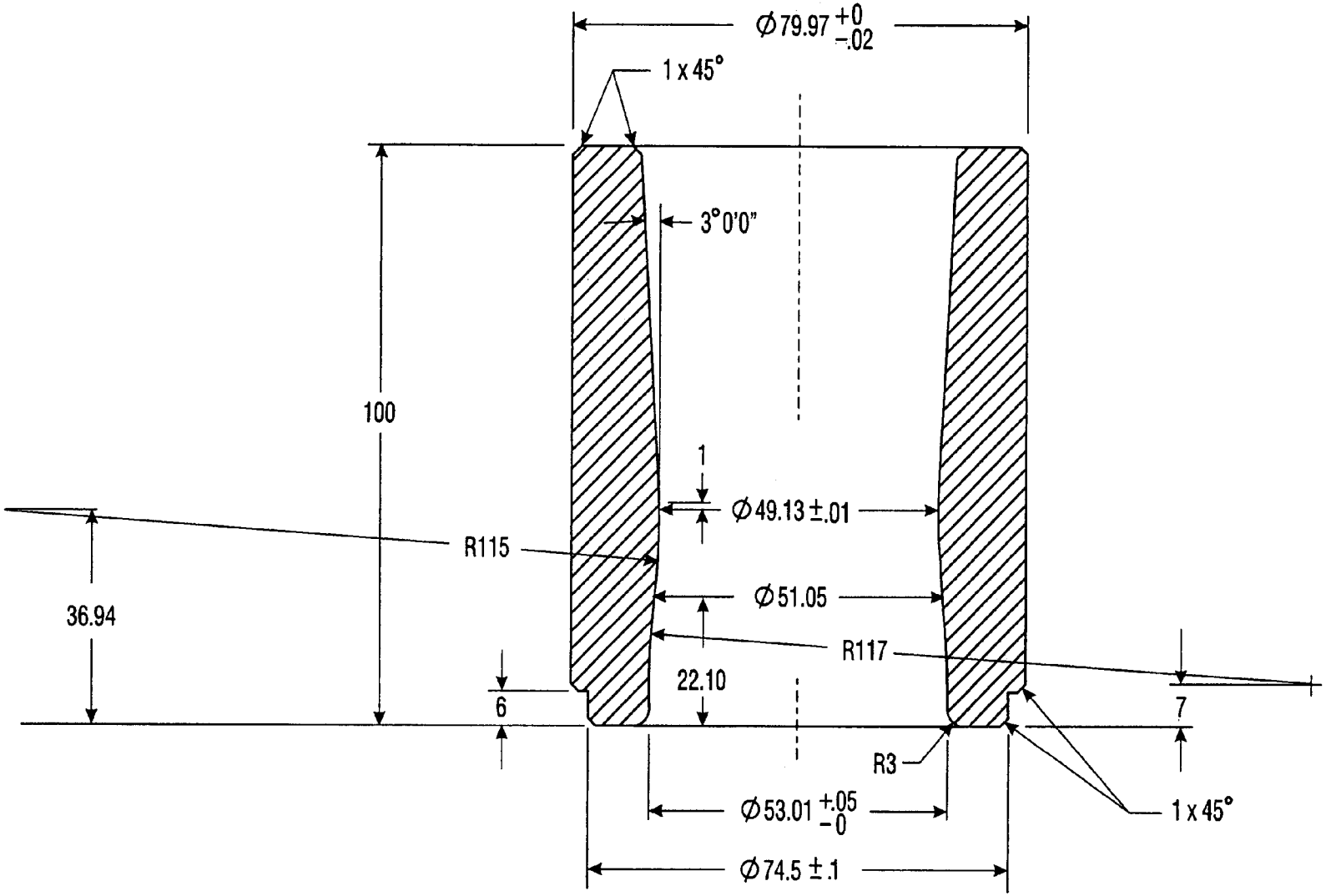
Figure 17:
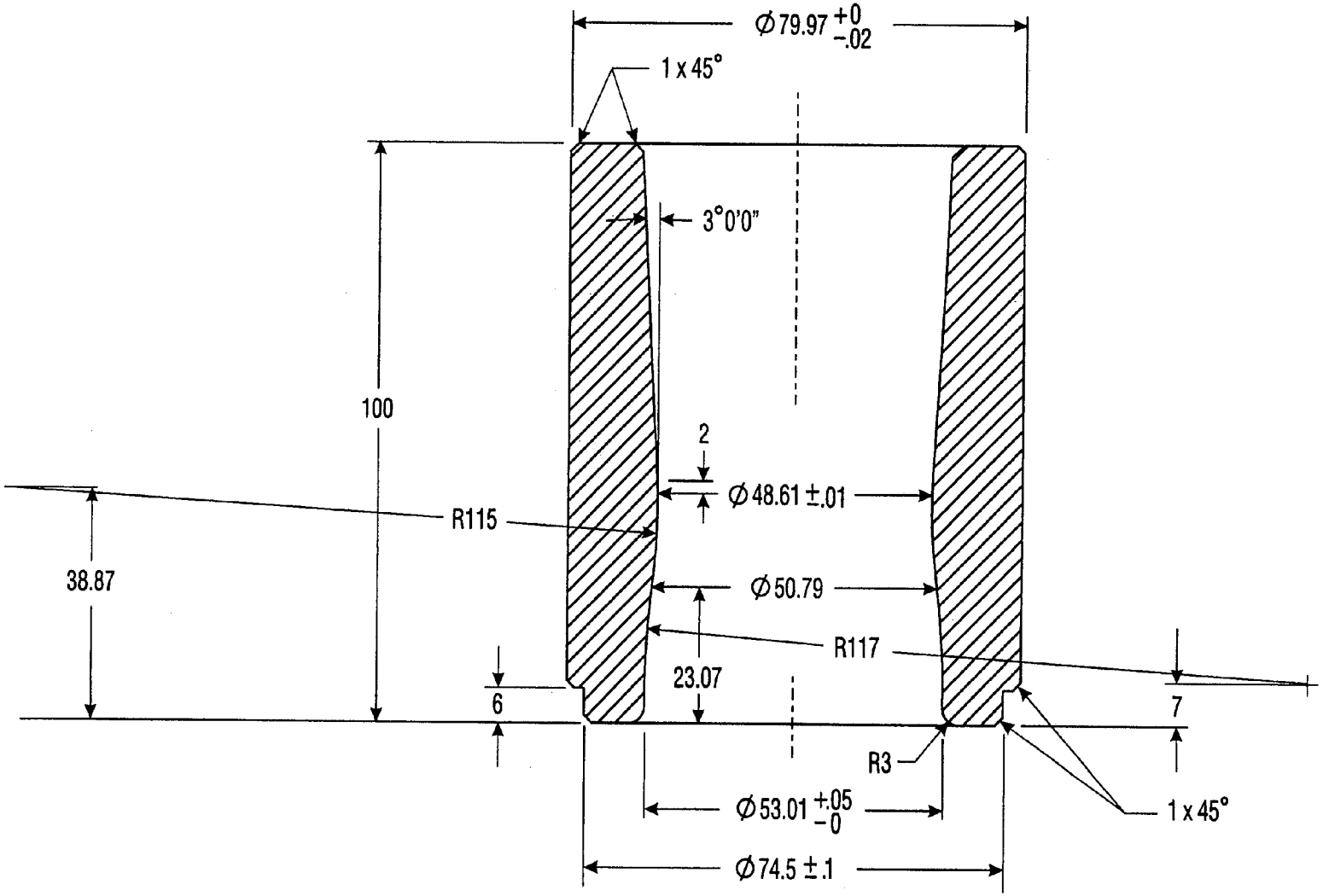
Figure 18:
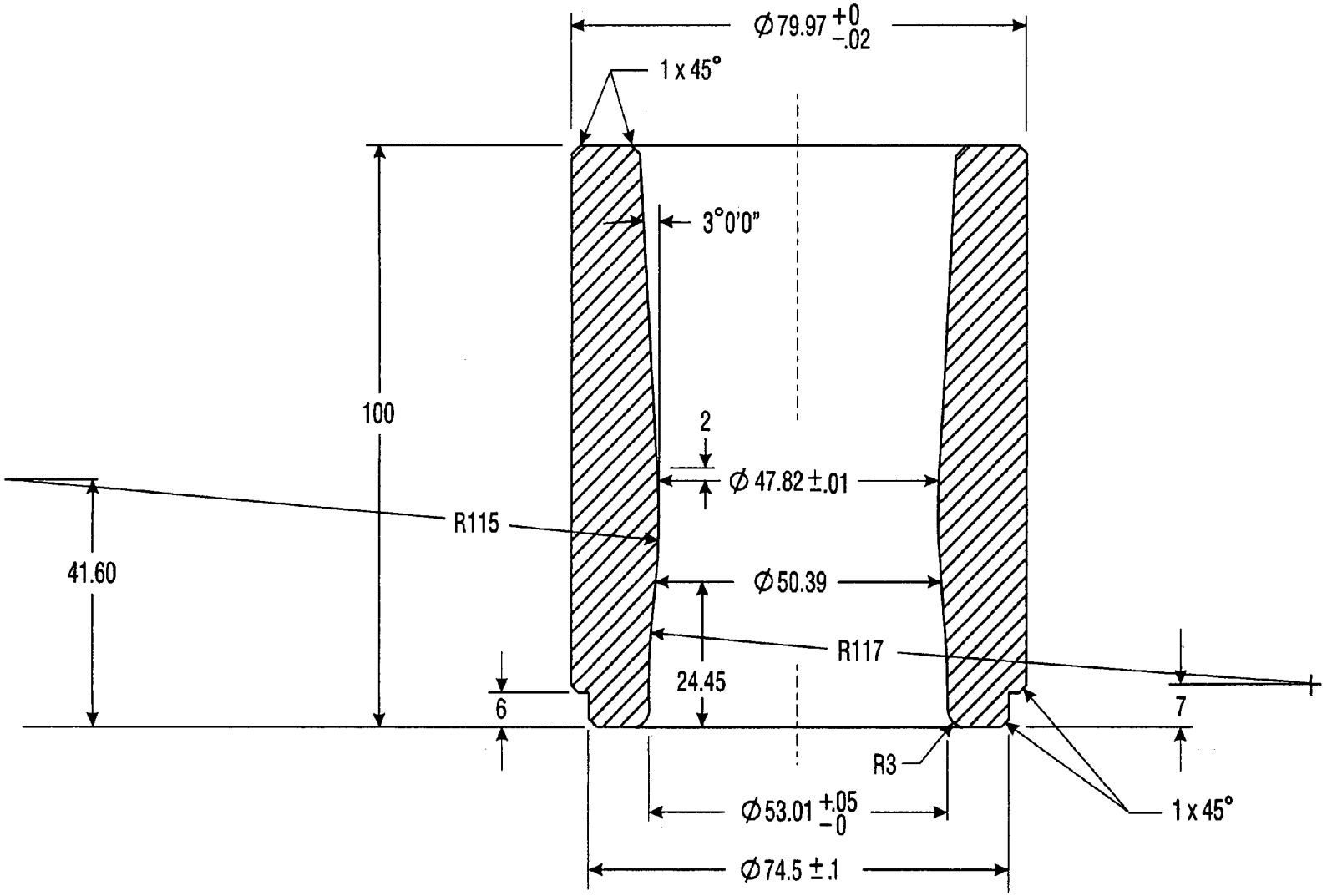
Figure 19:
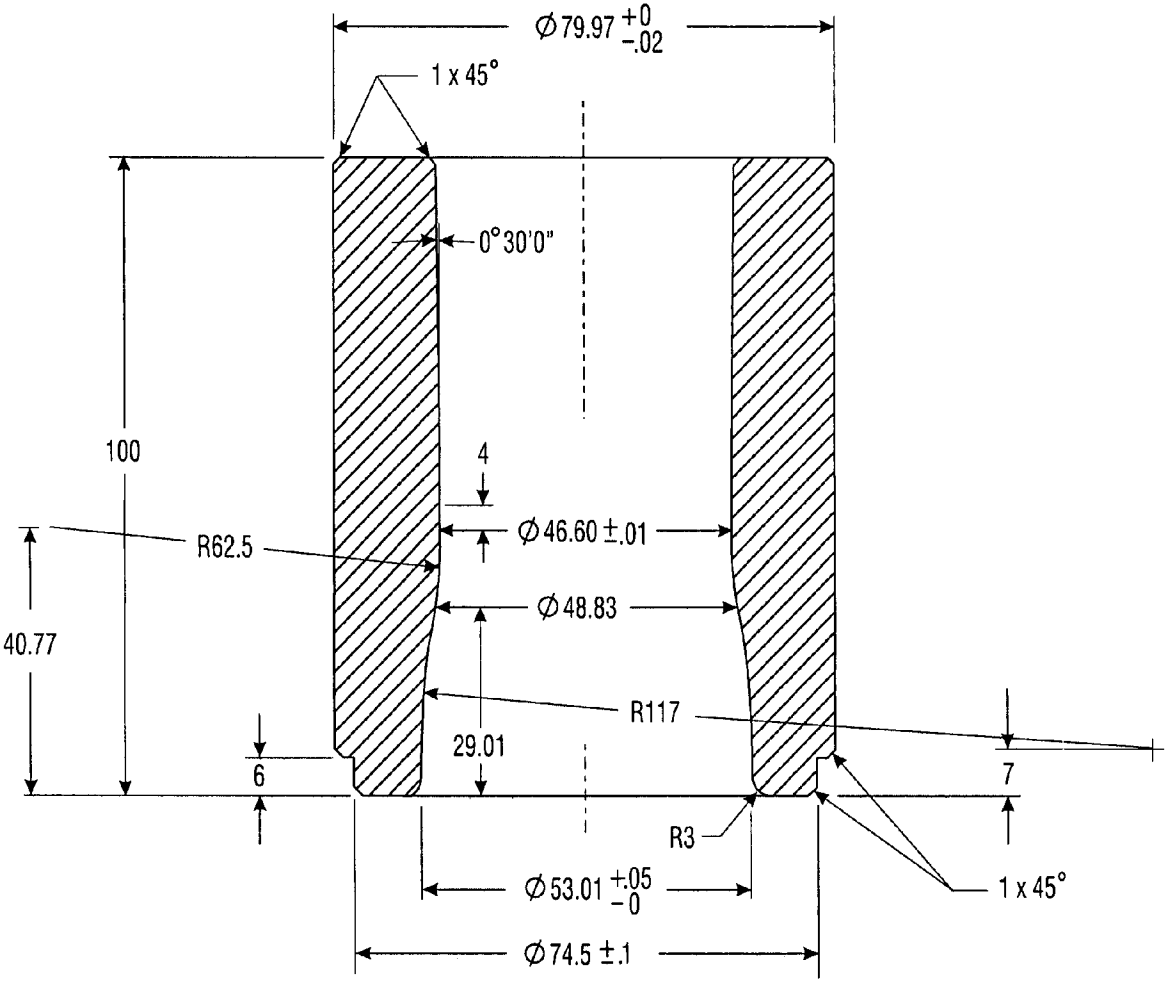
Figure 20:
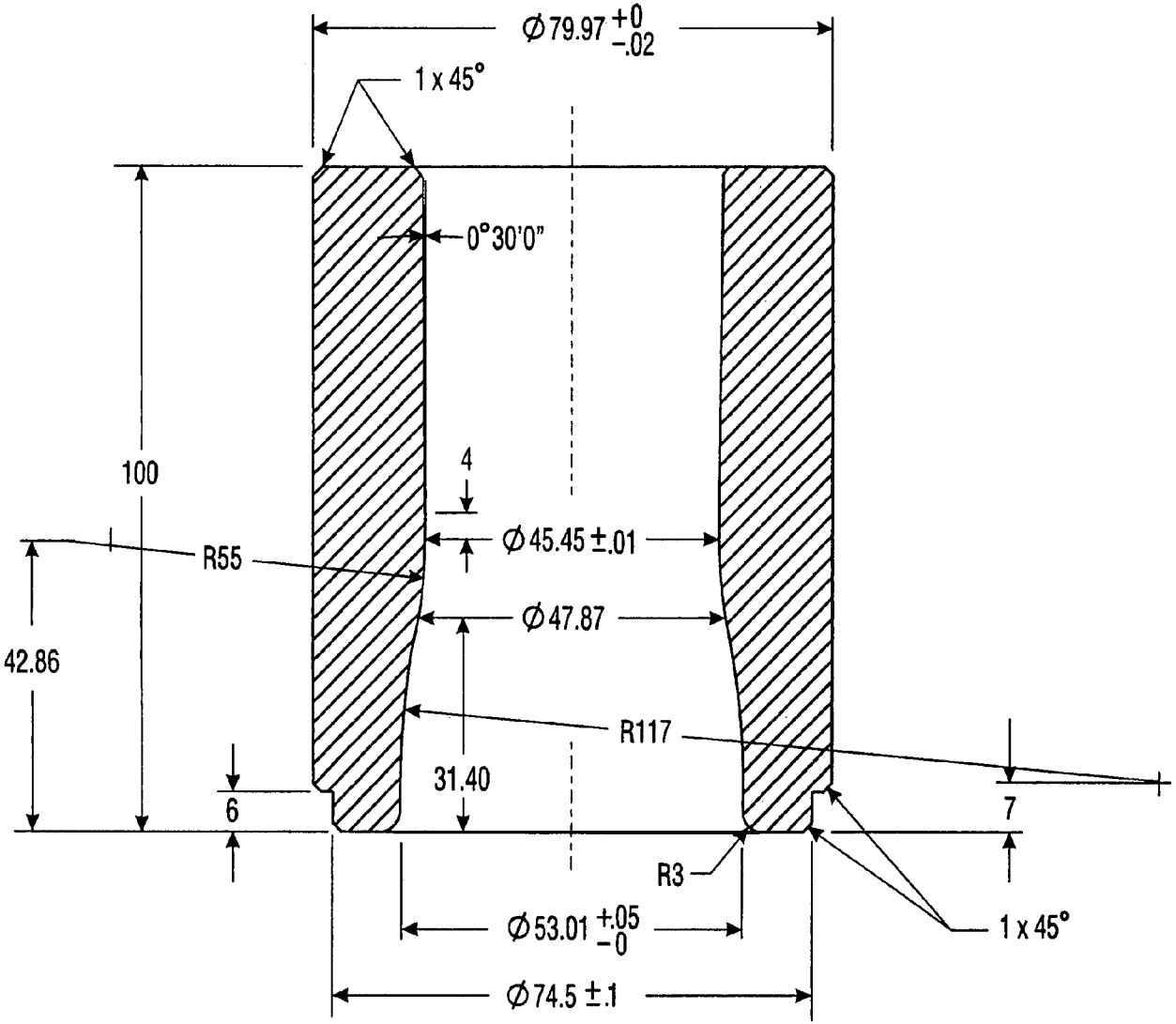
Figure 21:
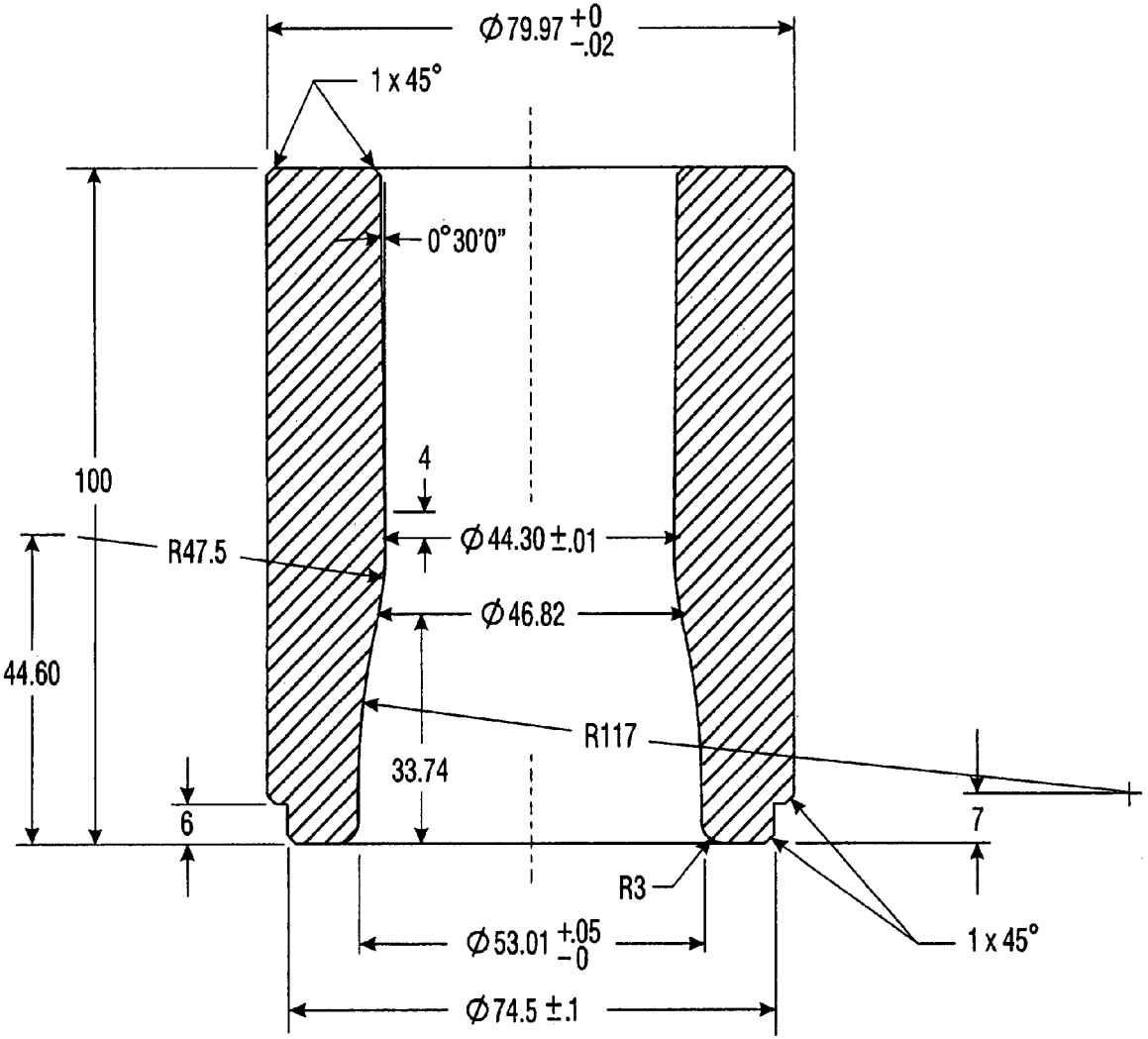
Figure 22:
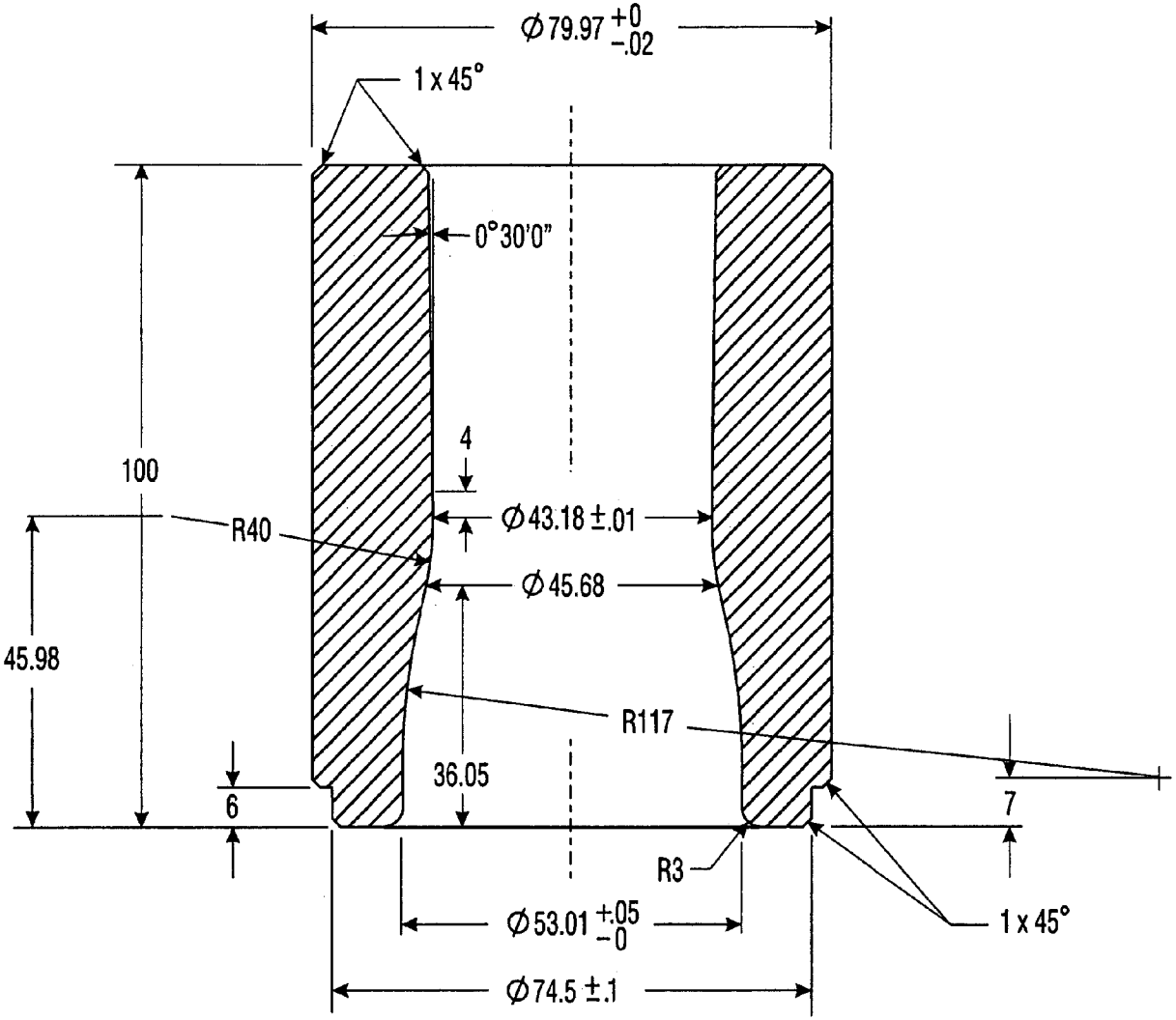
Figure 23:
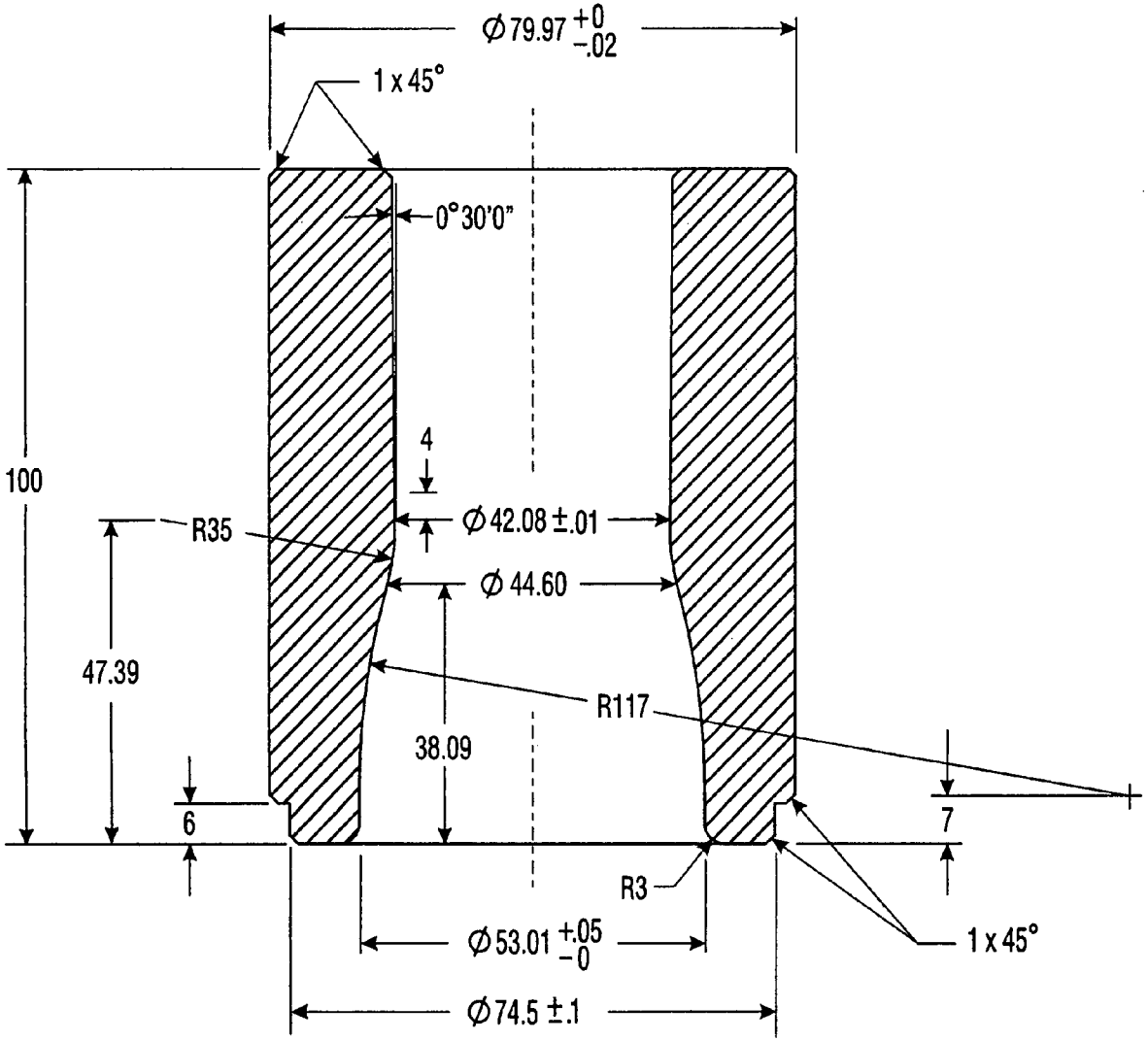
Figure 24:
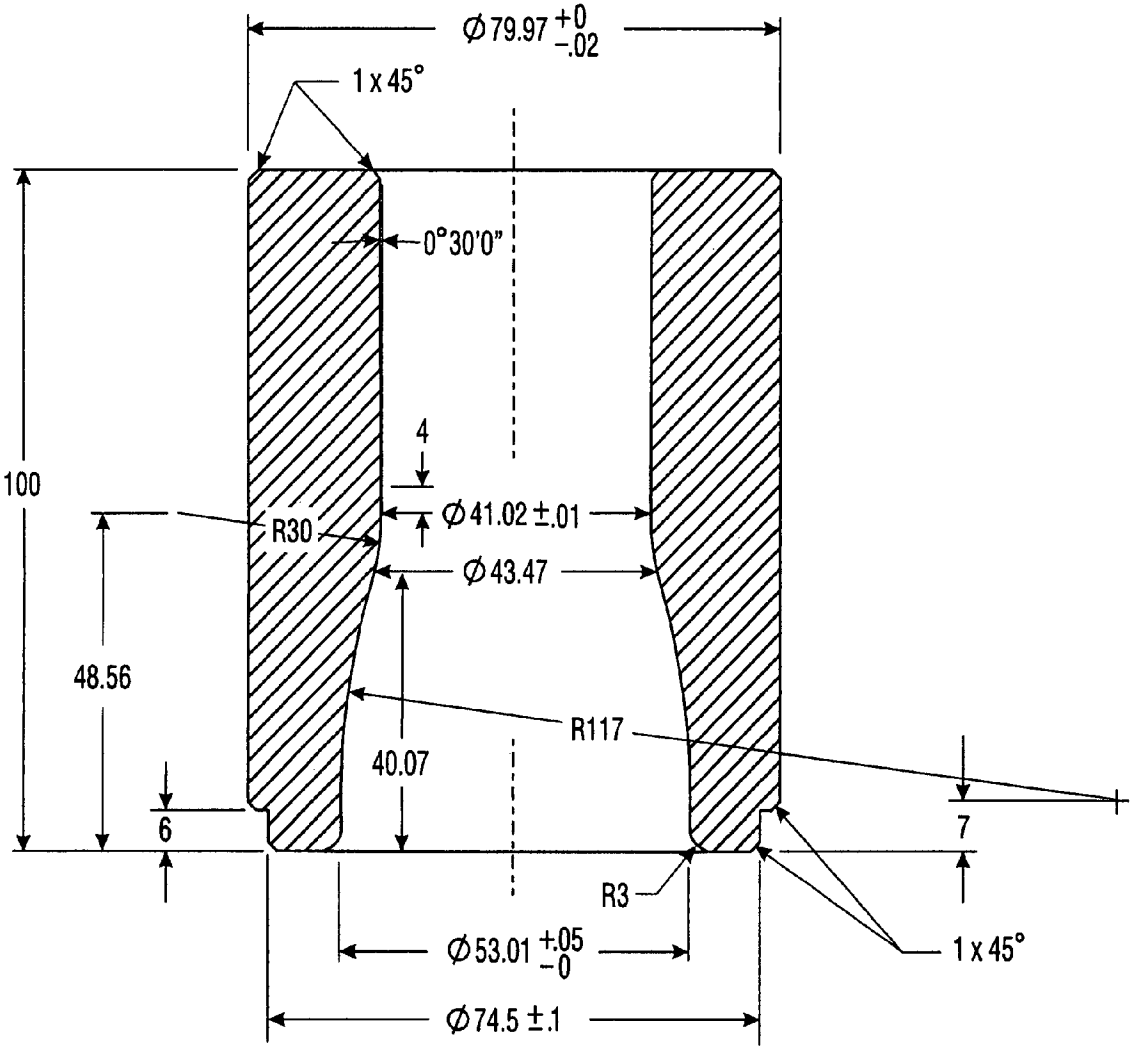
Figure 25:
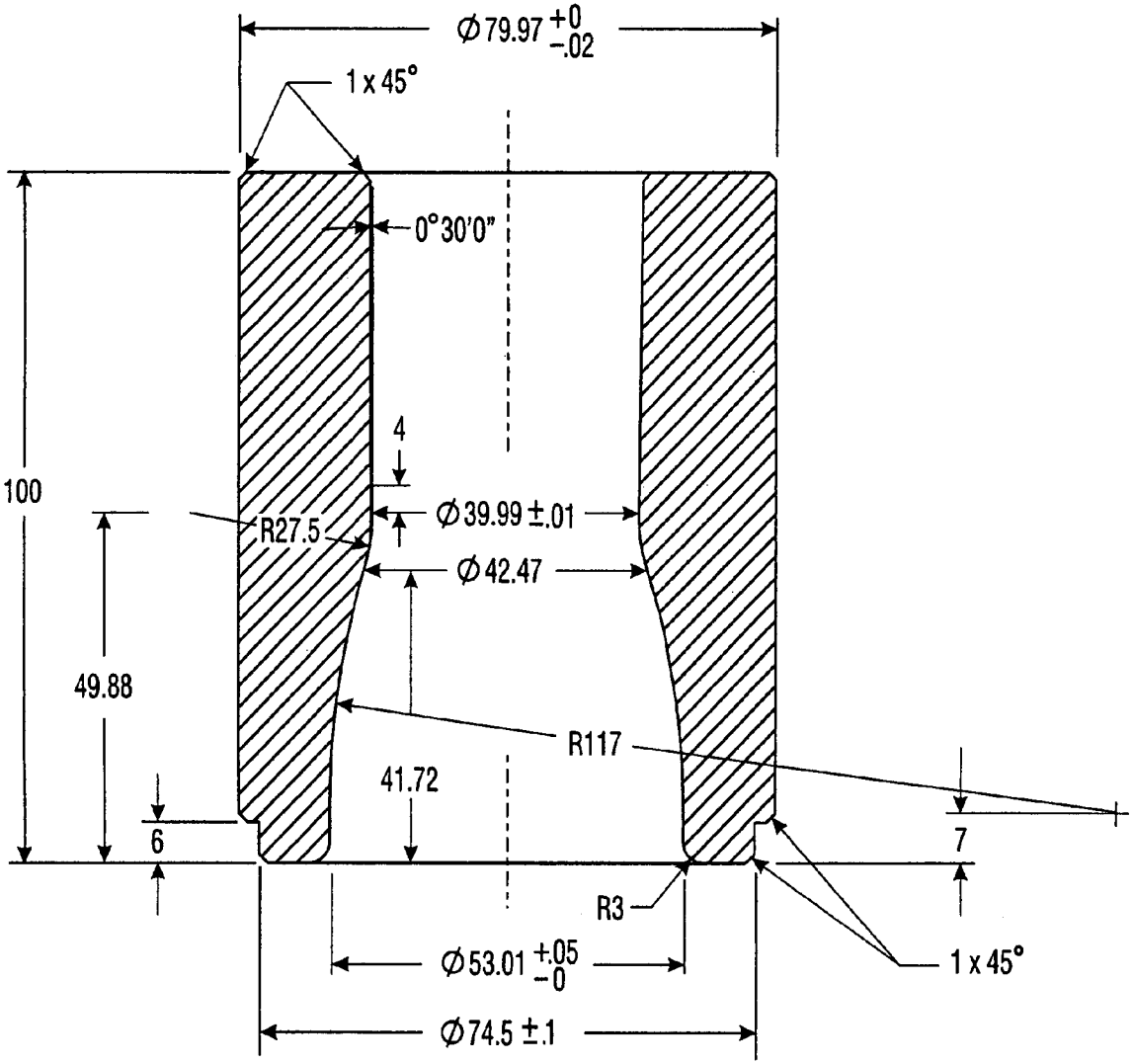
Figure 26:
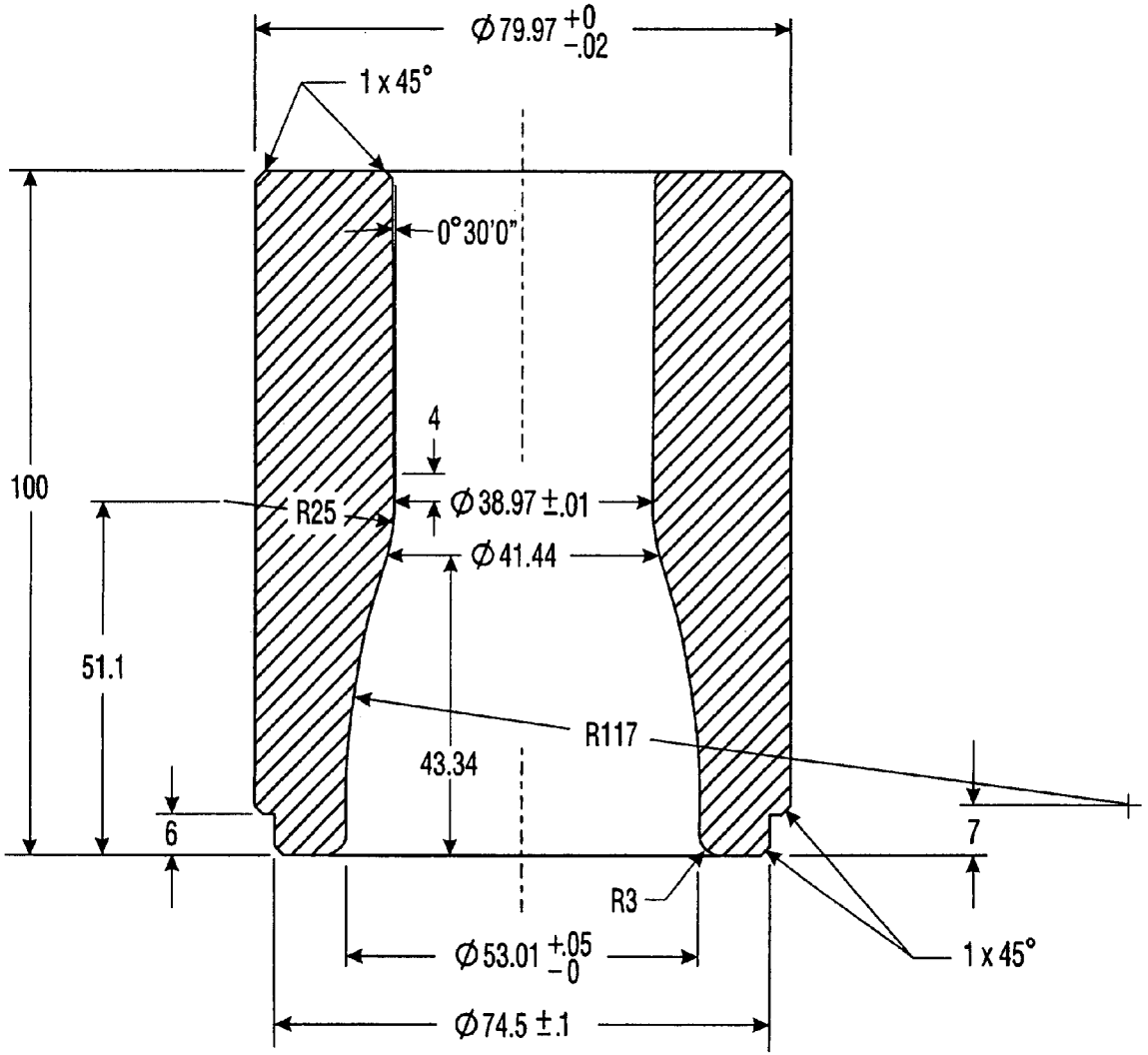
Figure 27:
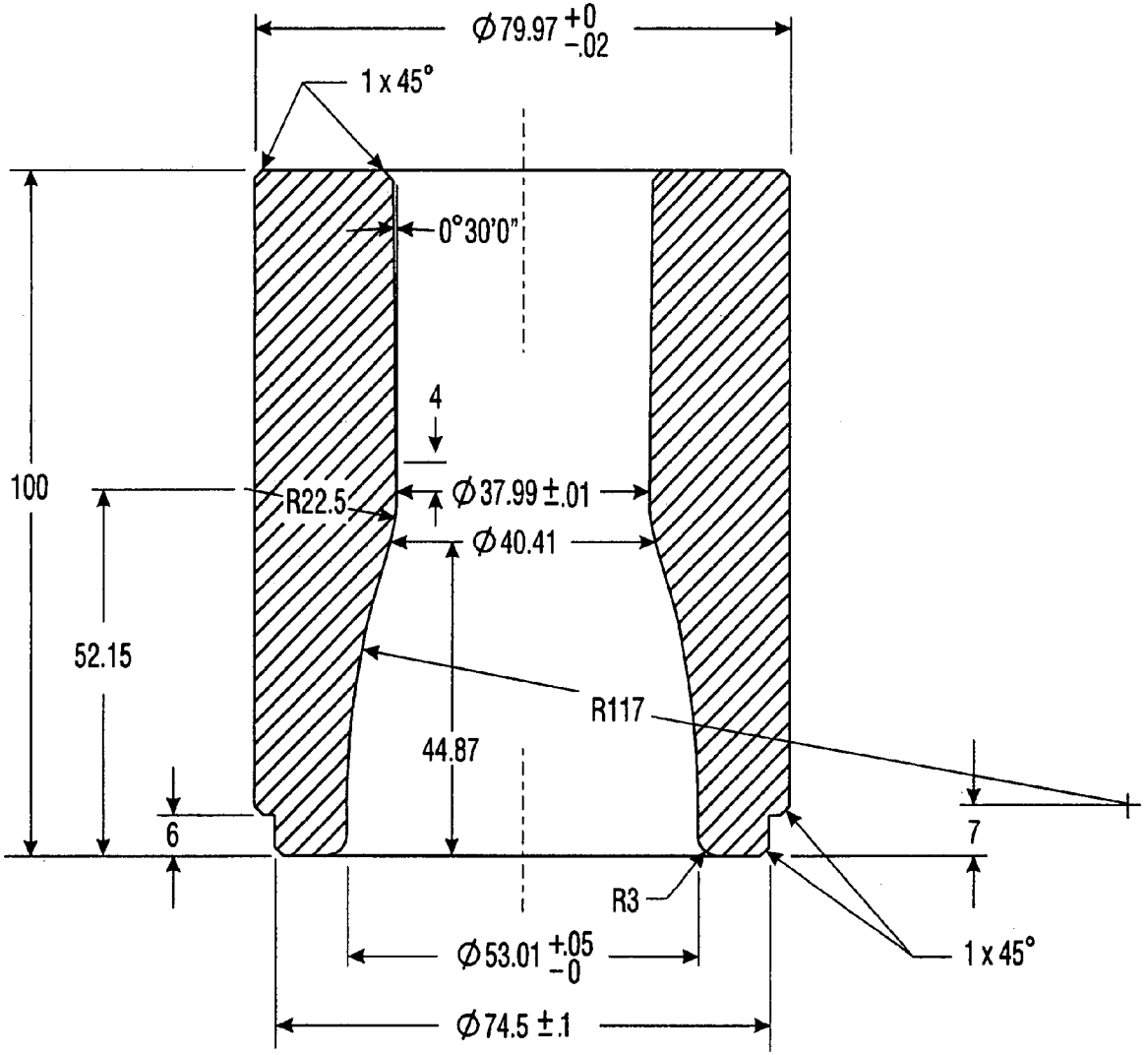
Figure 28:
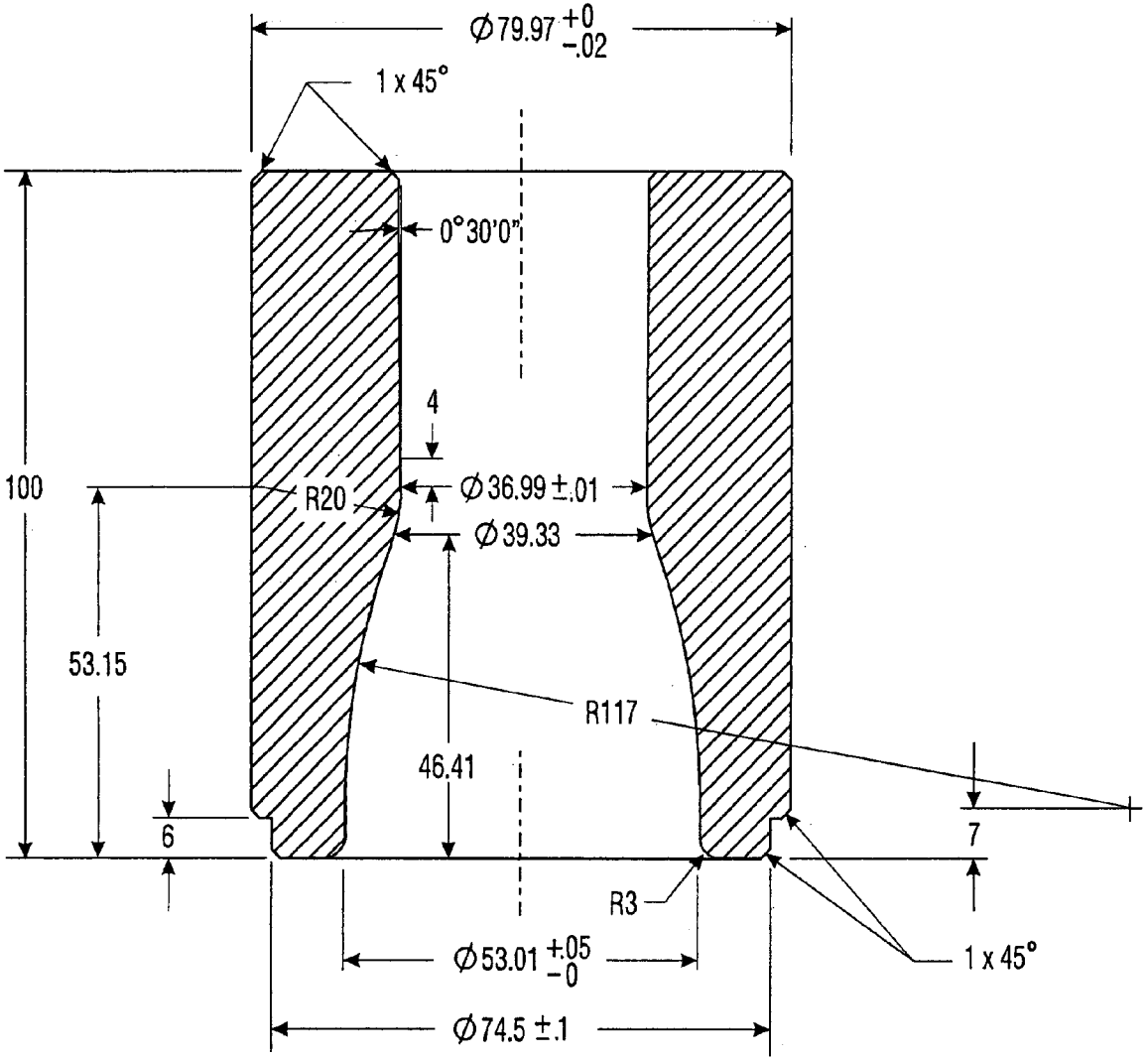
Figure 29:
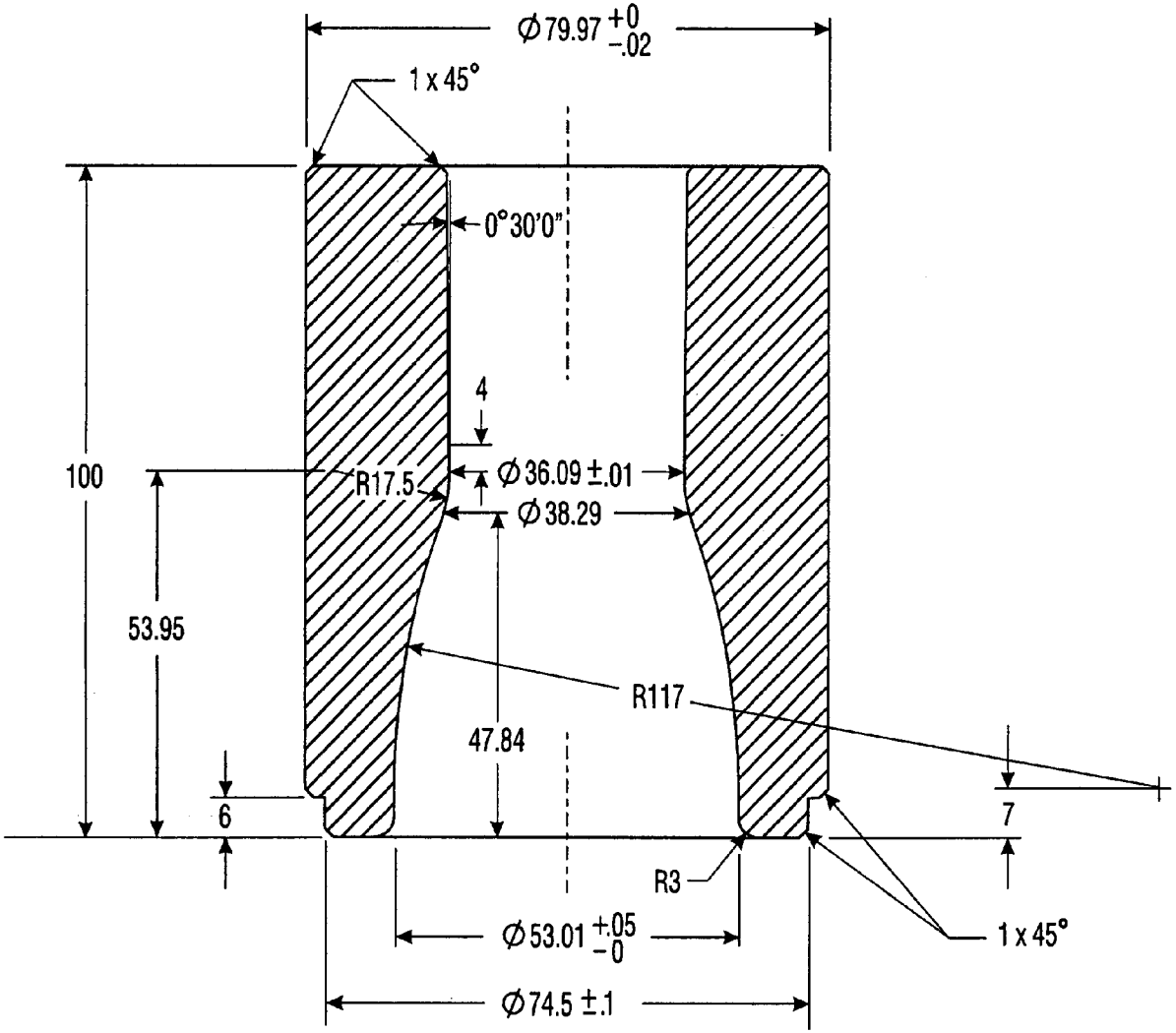
Figure 30:
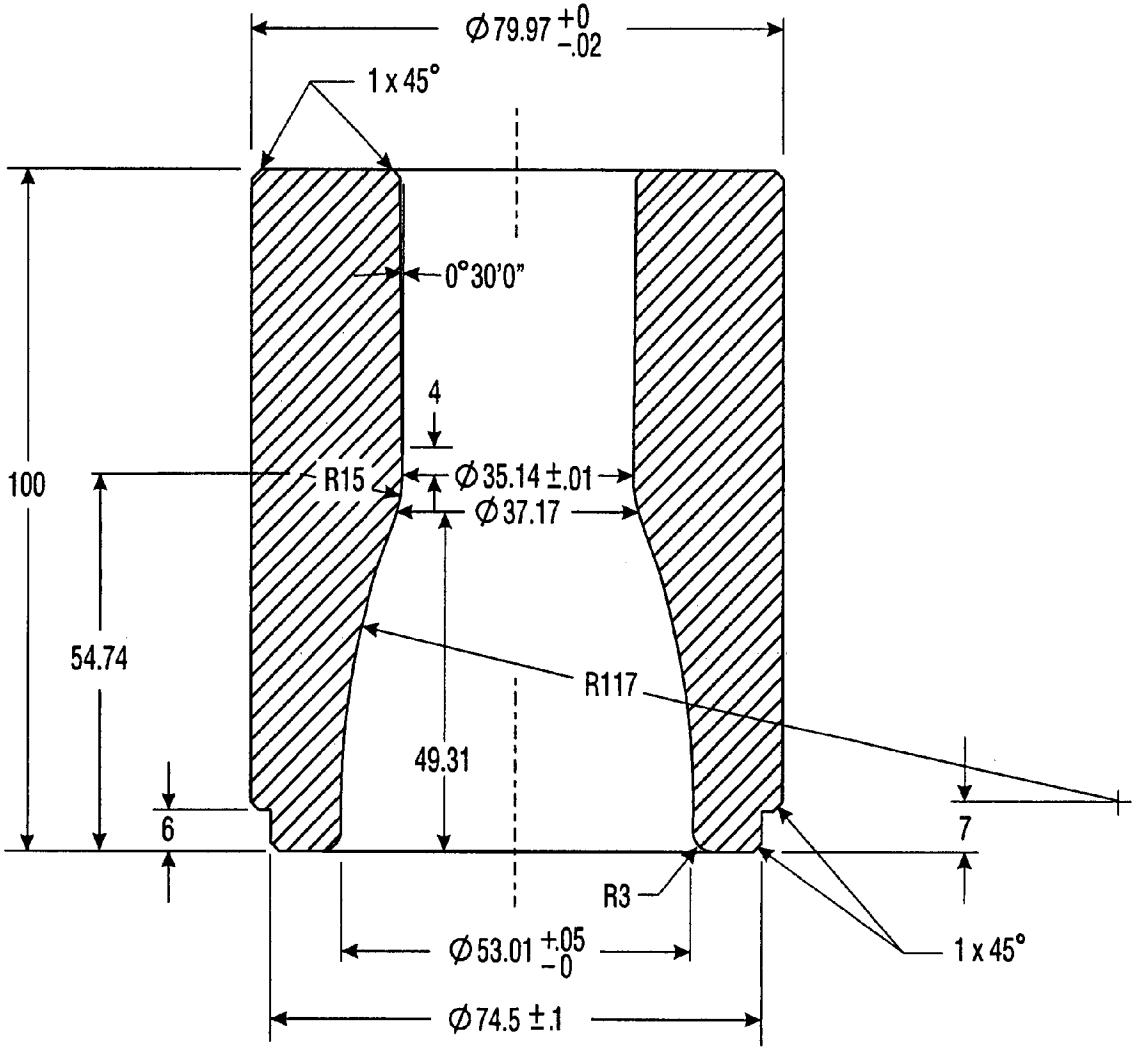
Figure 31:
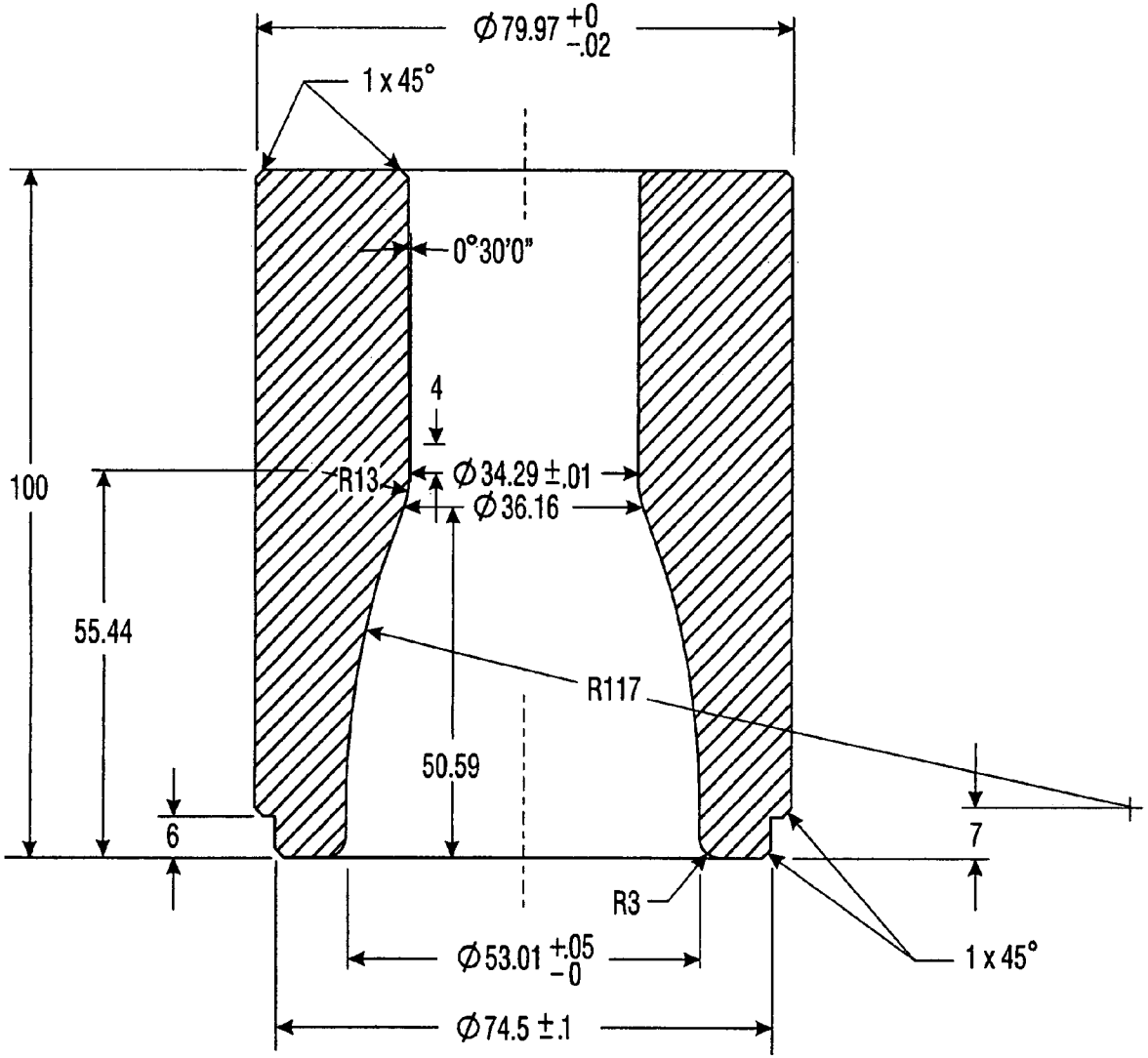
Figure 32:
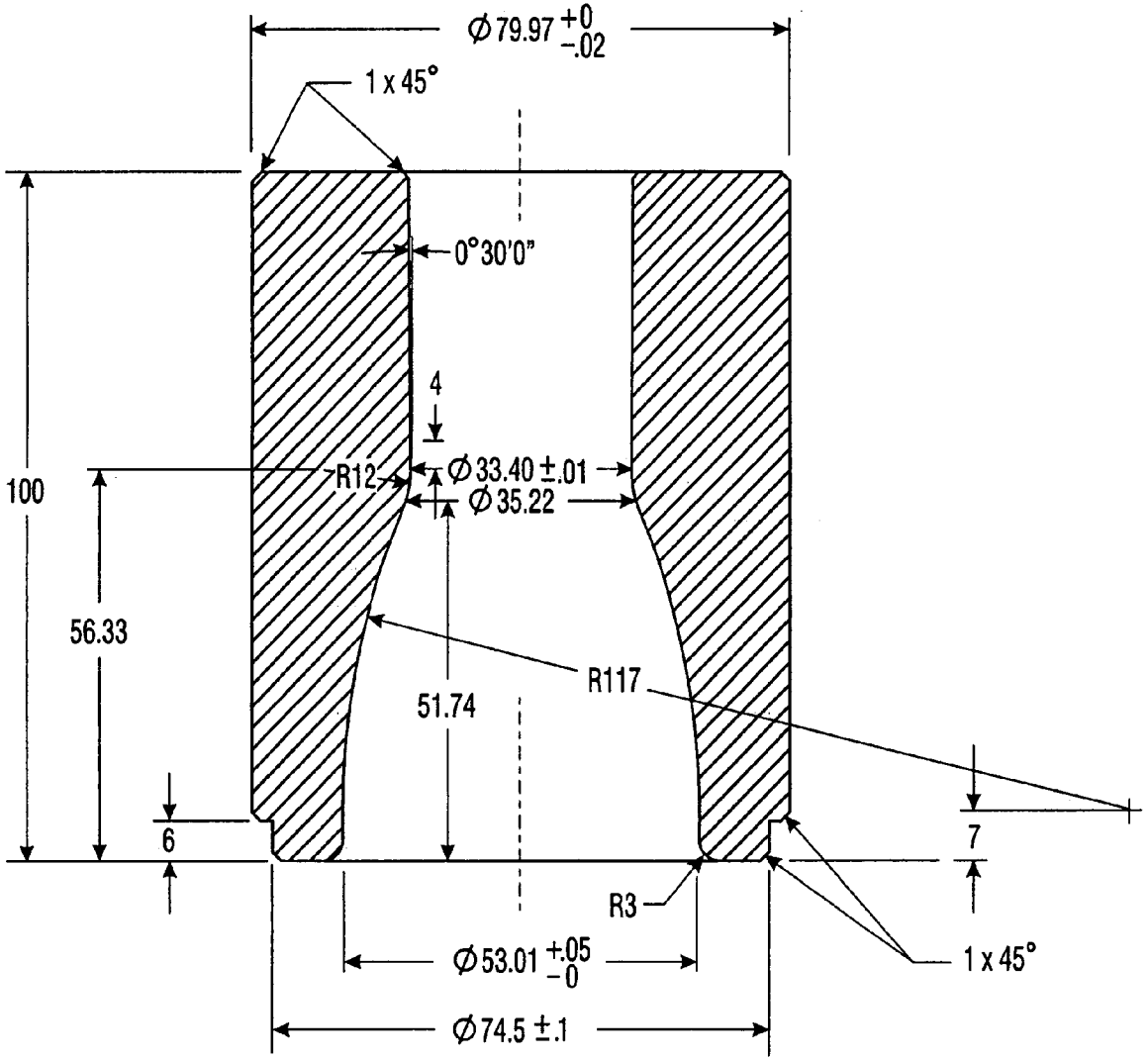
Figure 33:
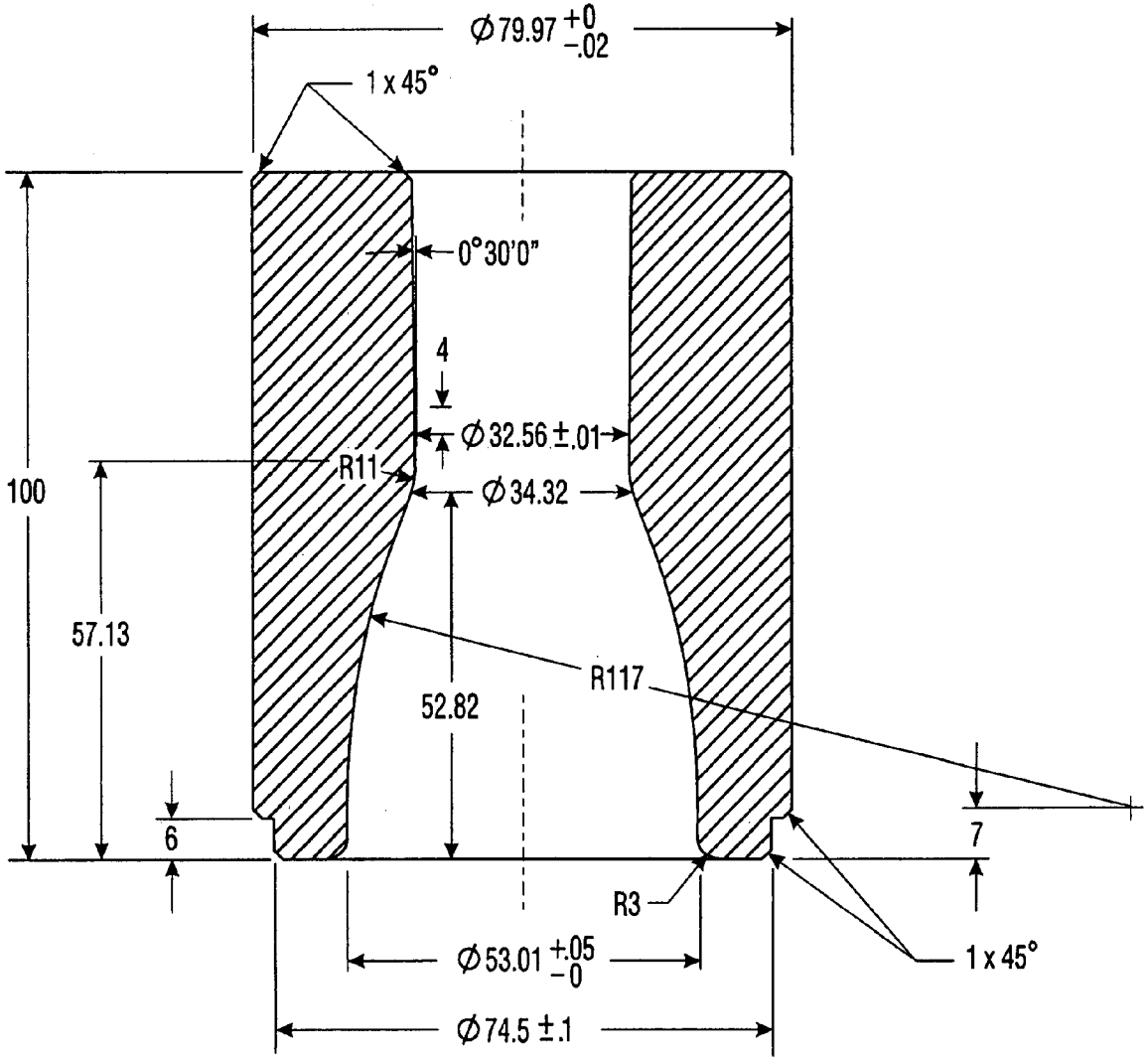
Figure 34:
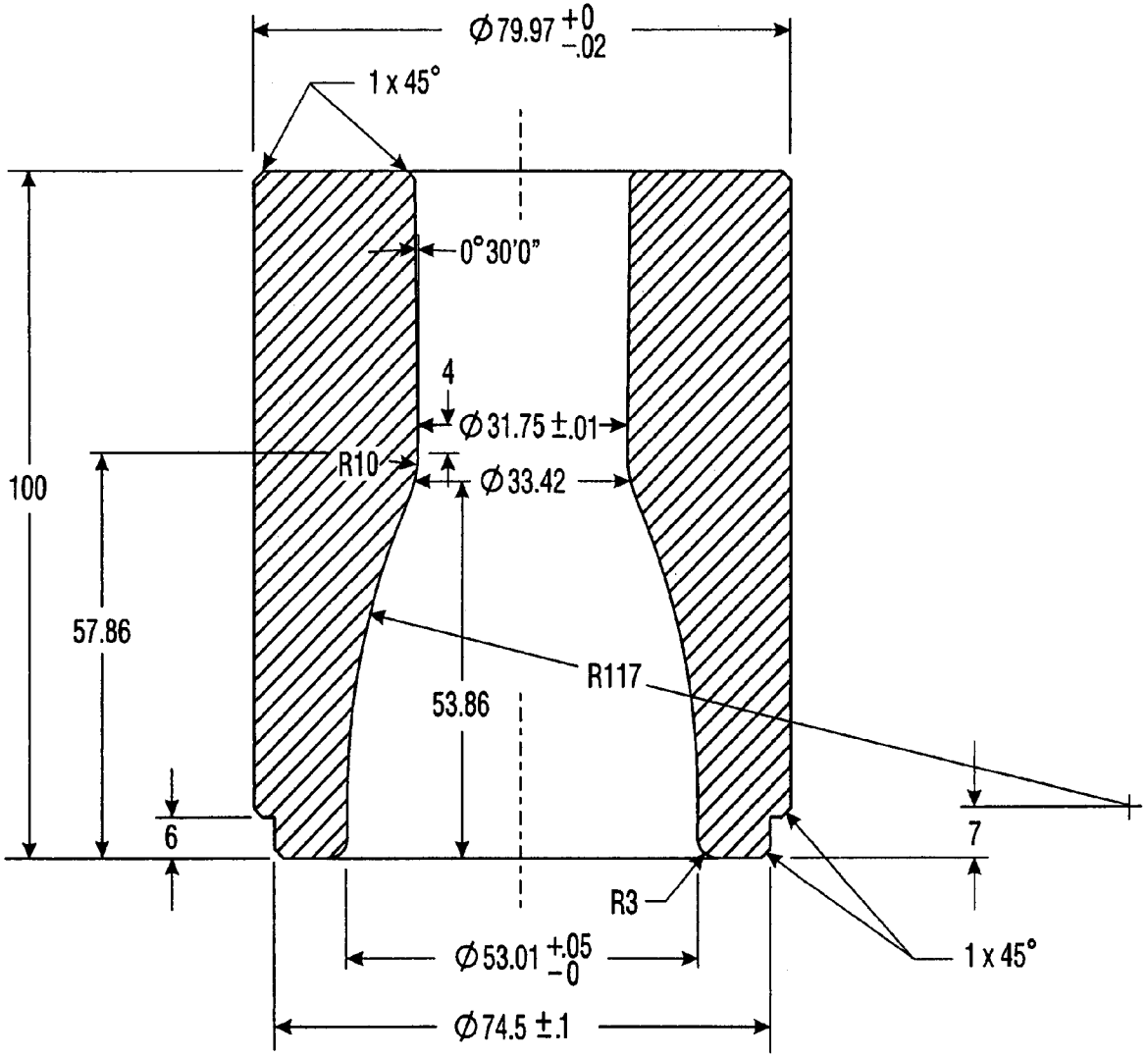
Figure 35:
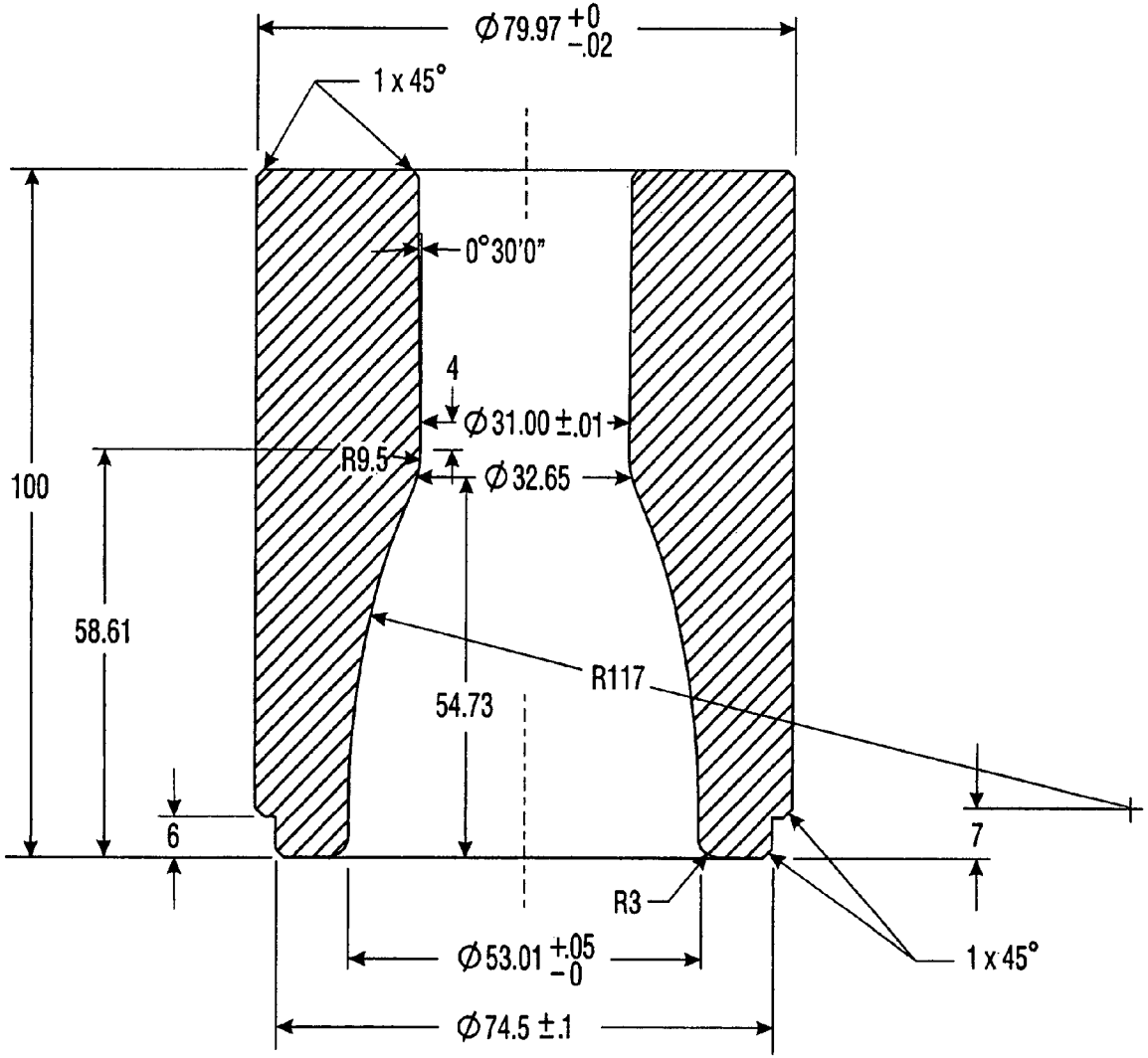
Figure 36:
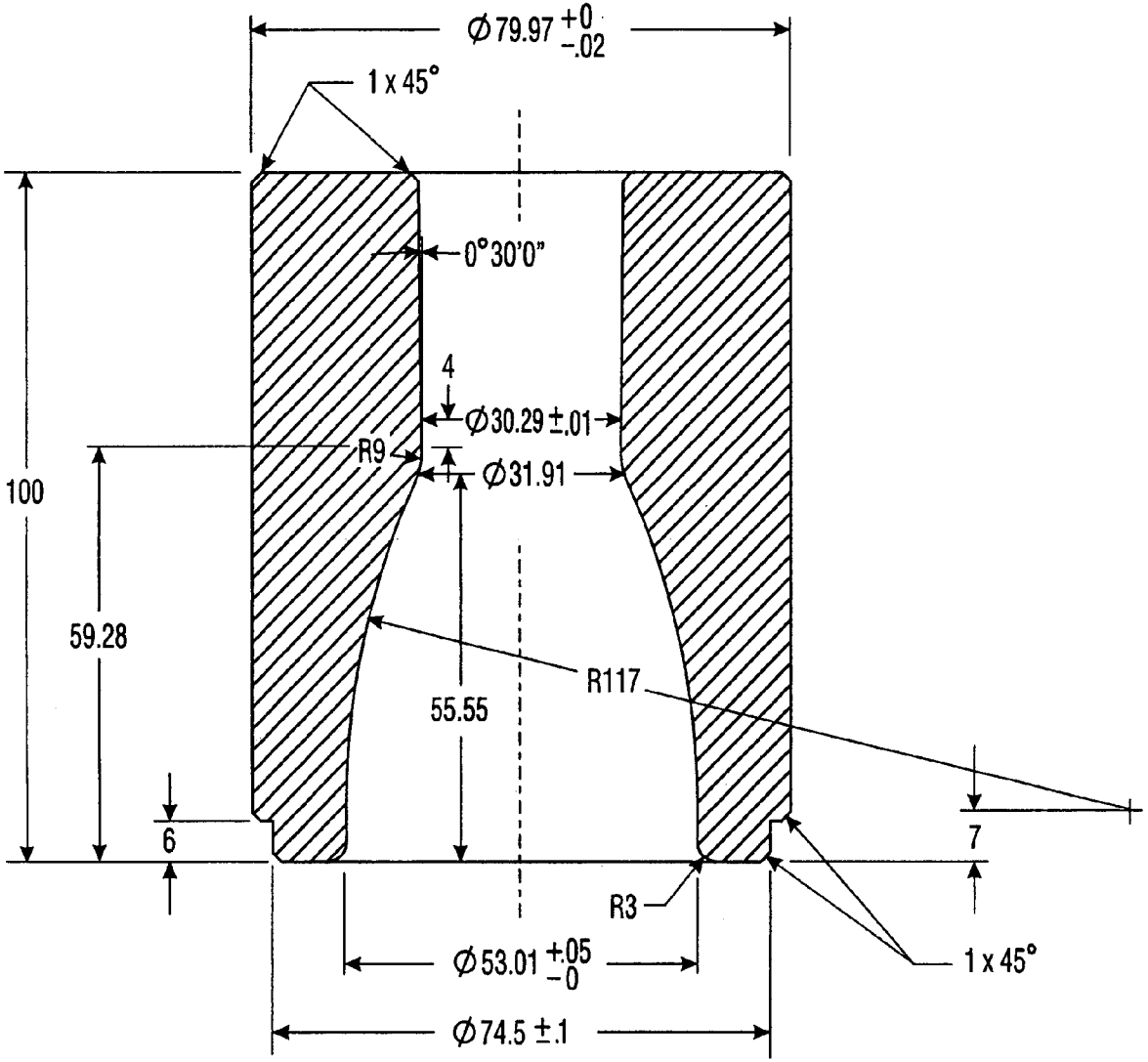
Figure 37:
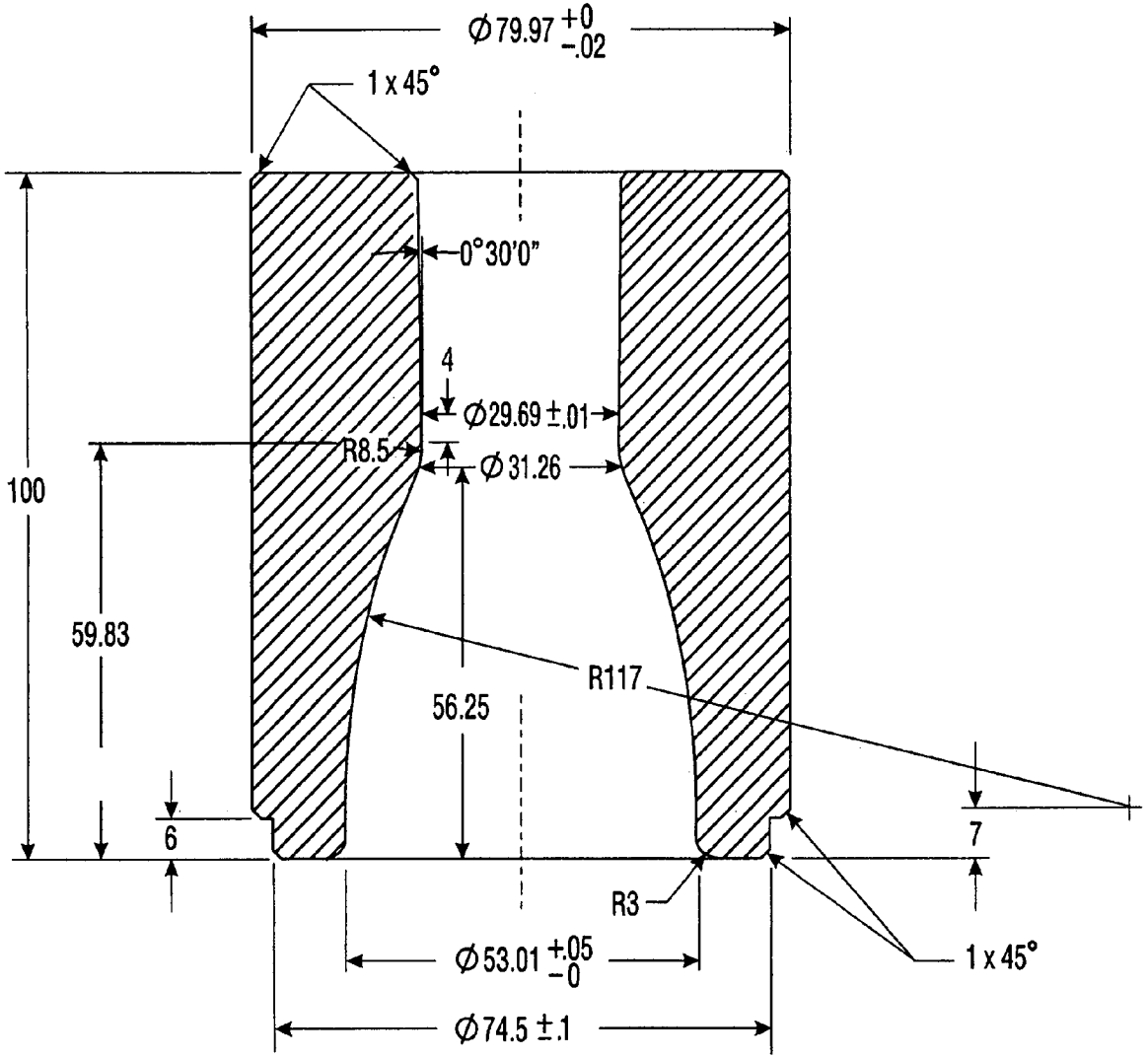
Figure 38:
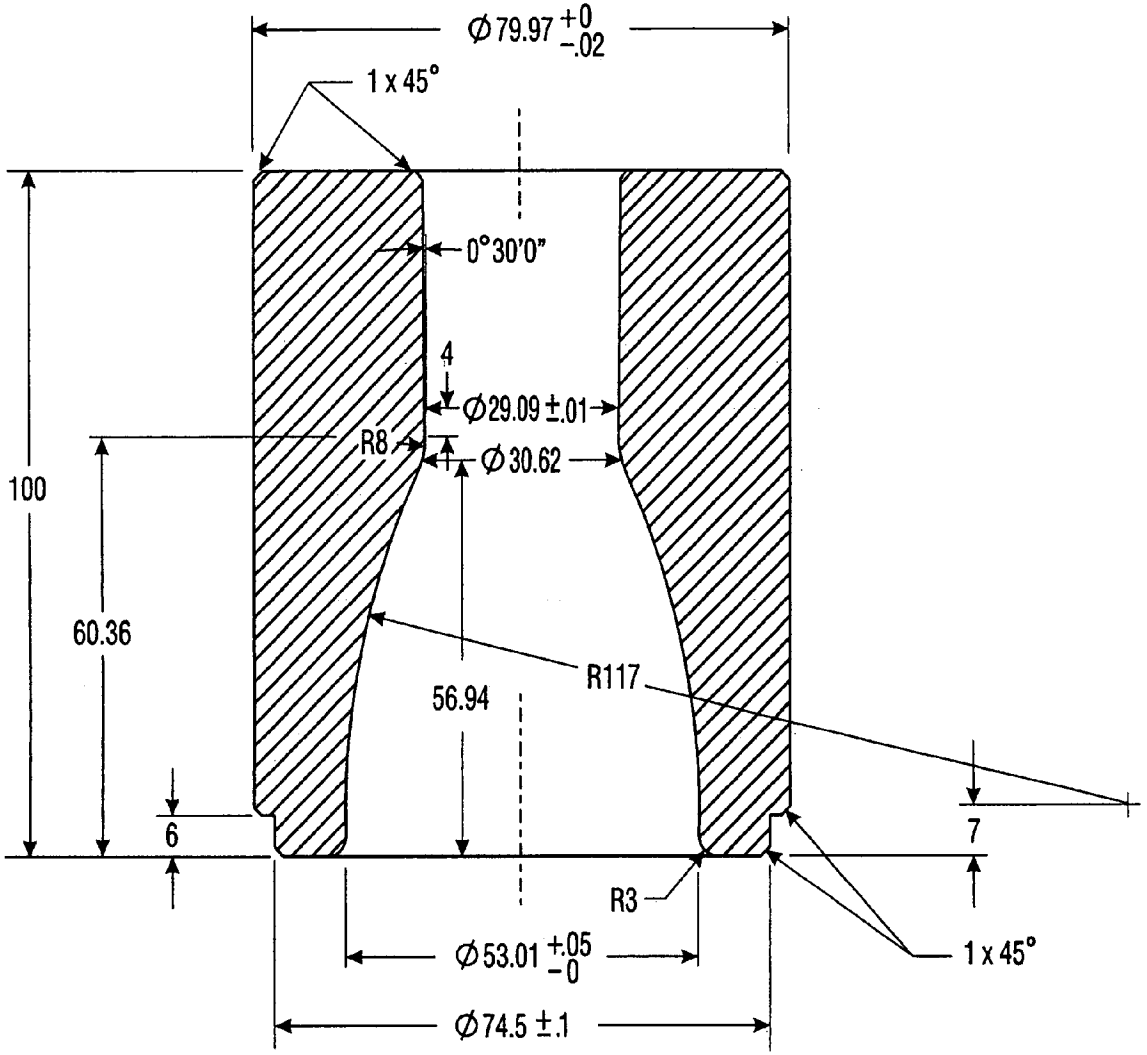
Figure 39:
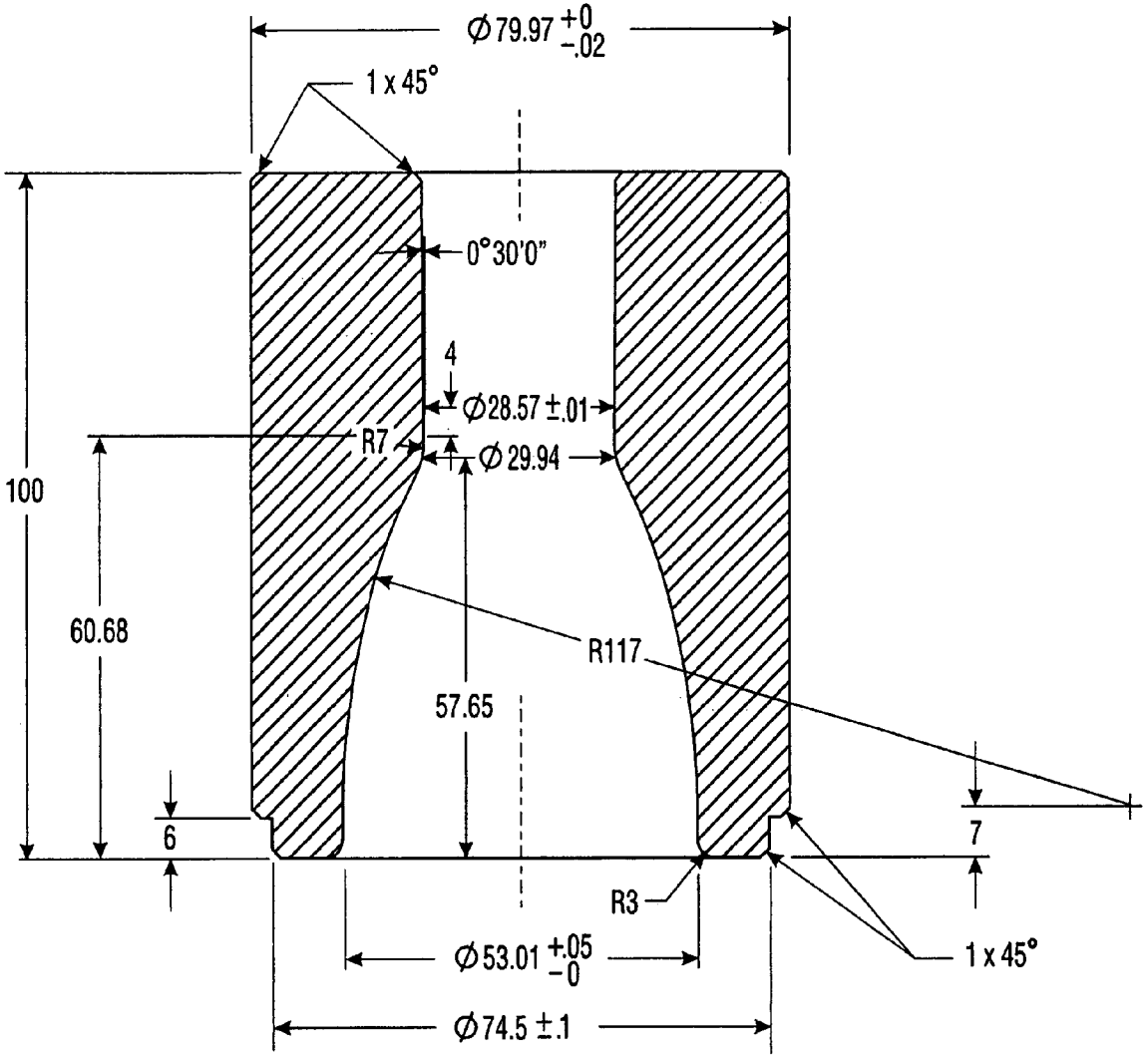
Figure 40:
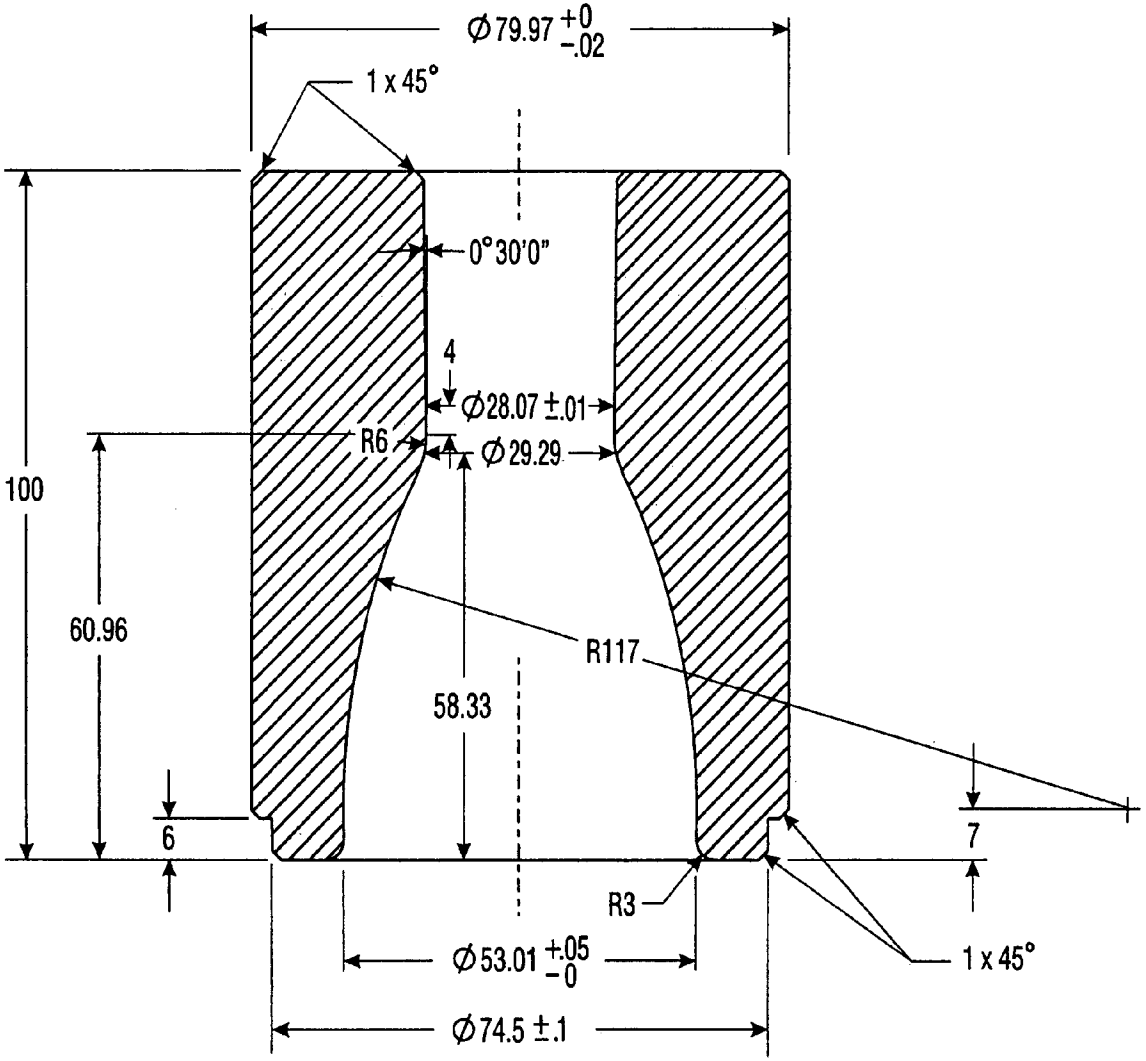
Figure 41:
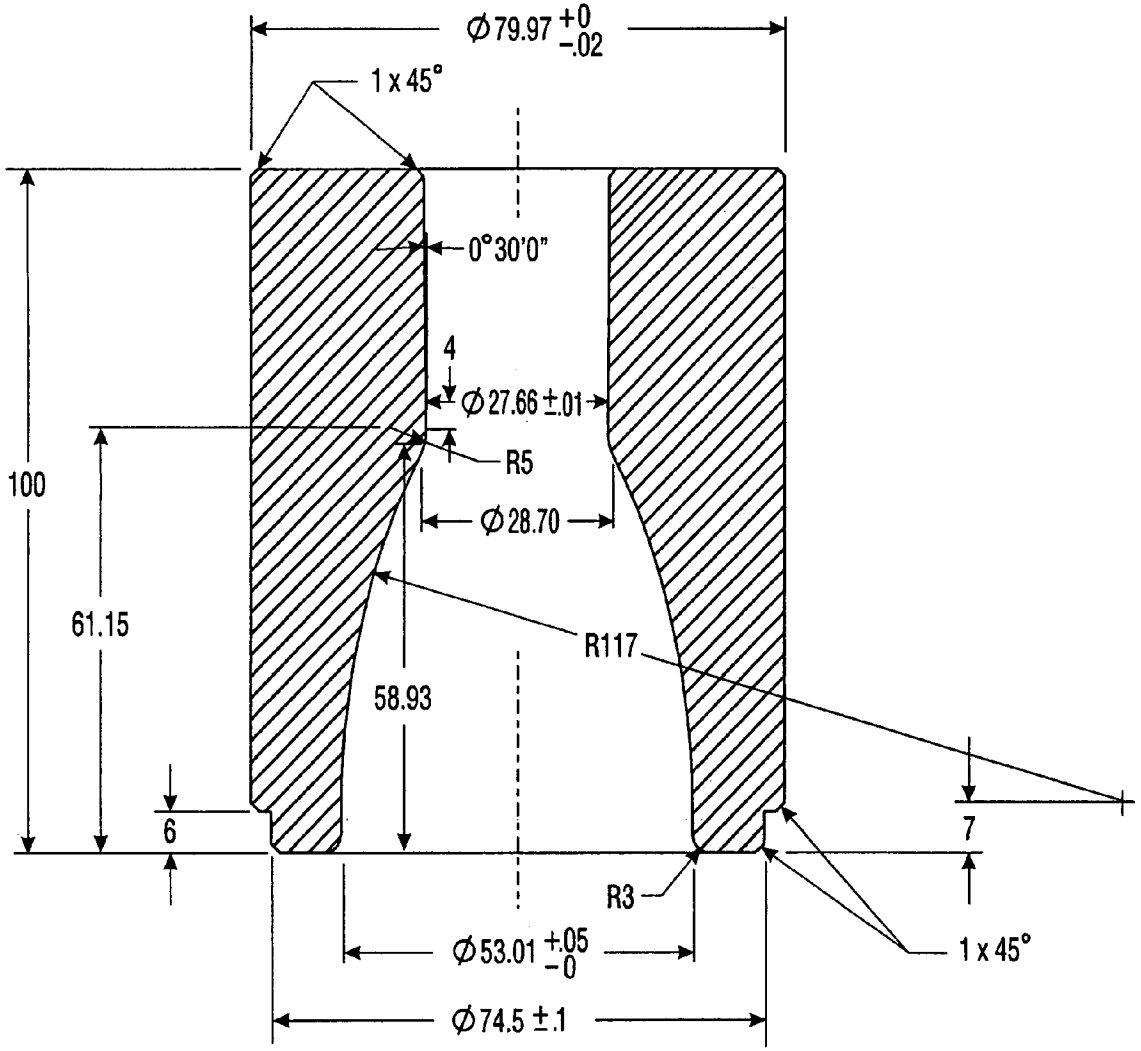
Figure 42:
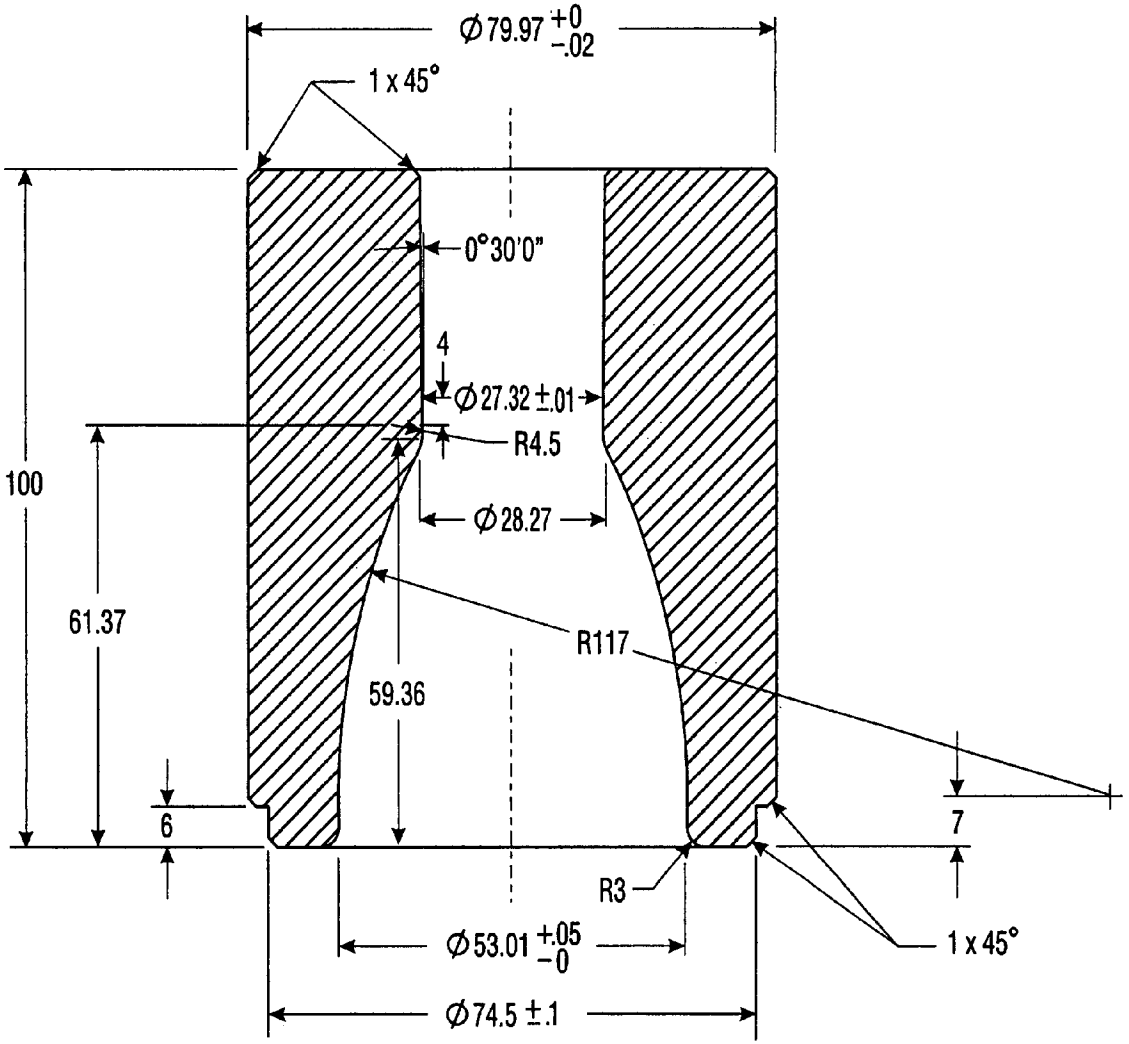
Figure 43:
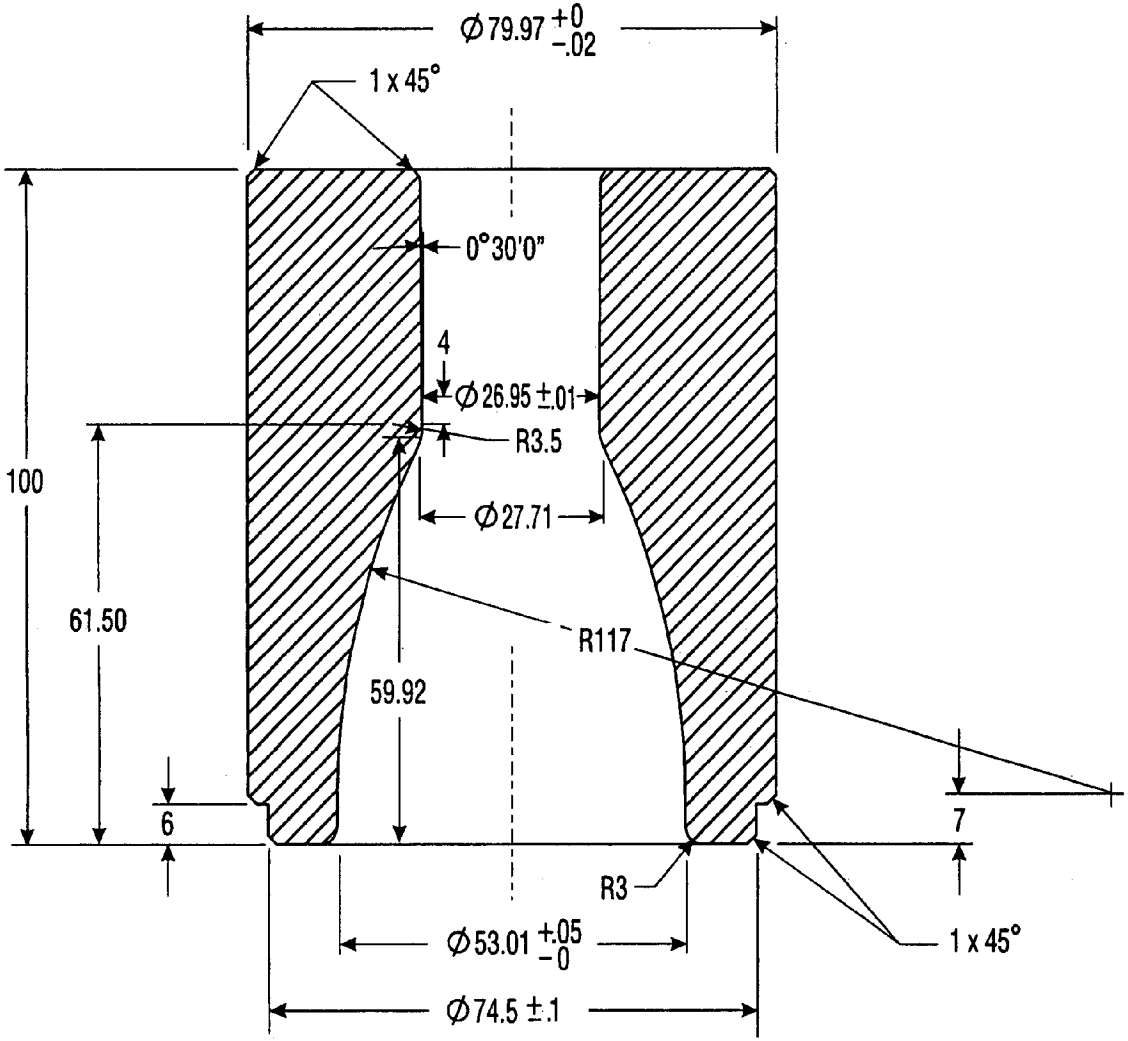
Figure 44:
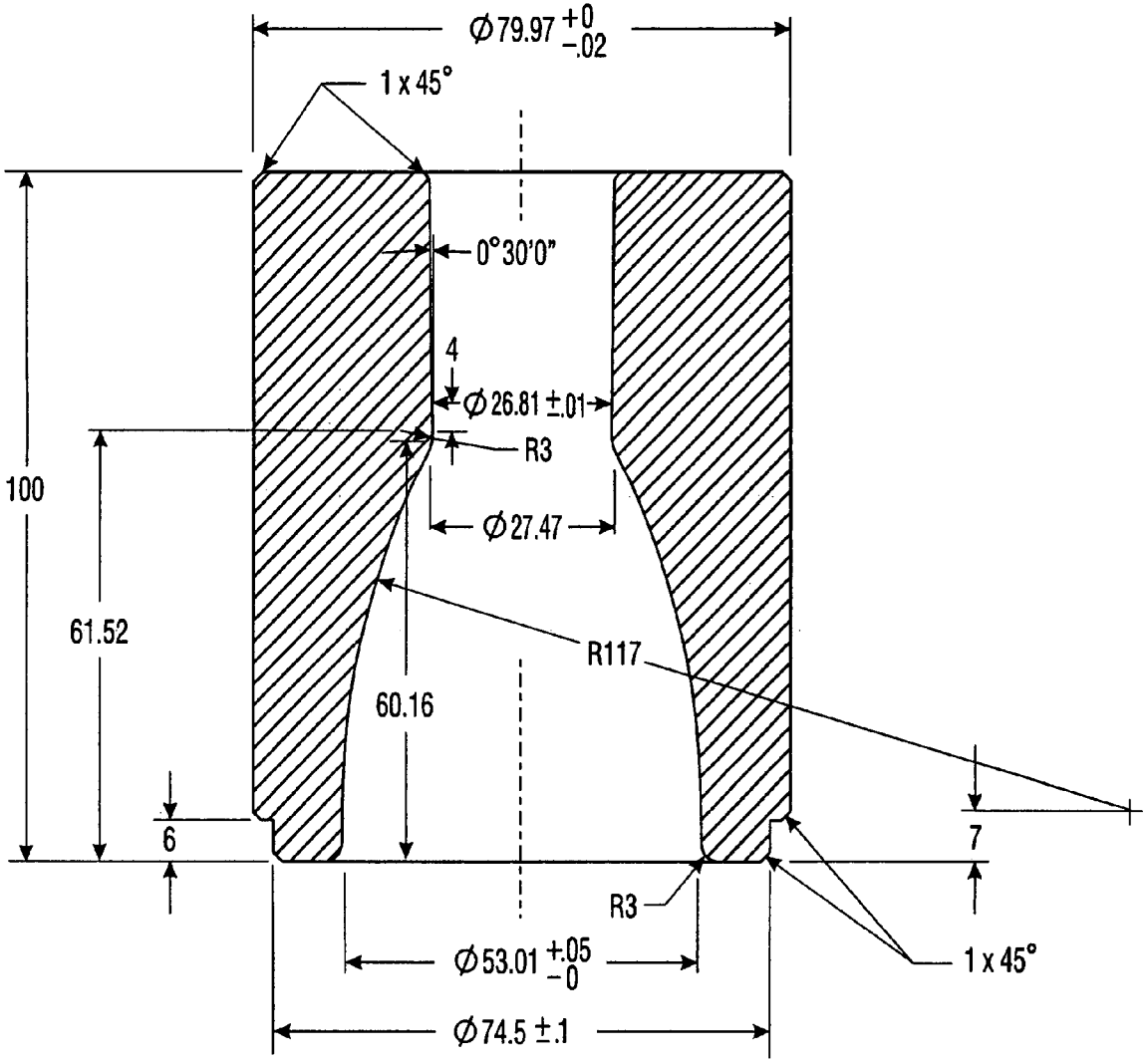
Figure 45:
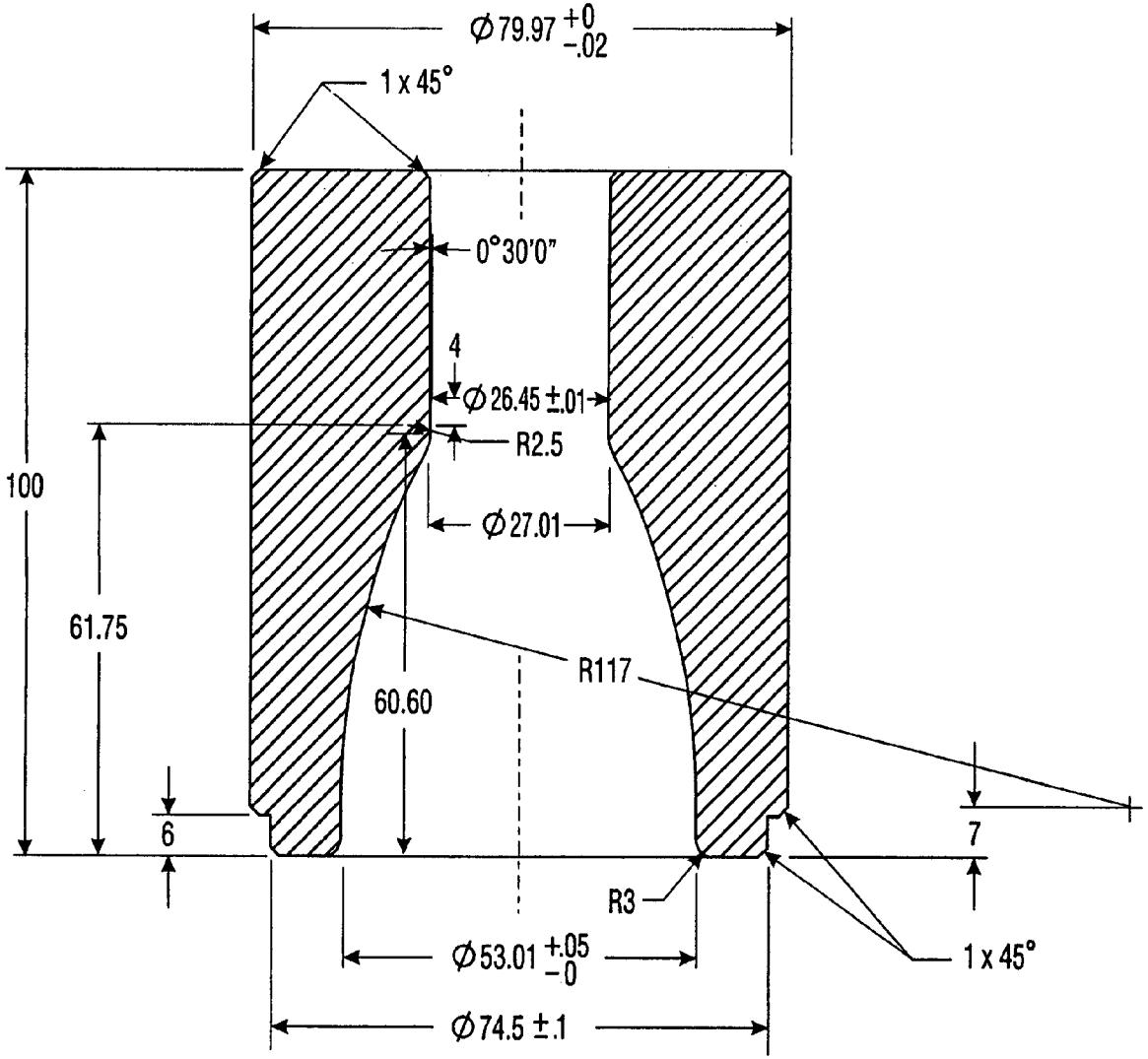
Figure 46:
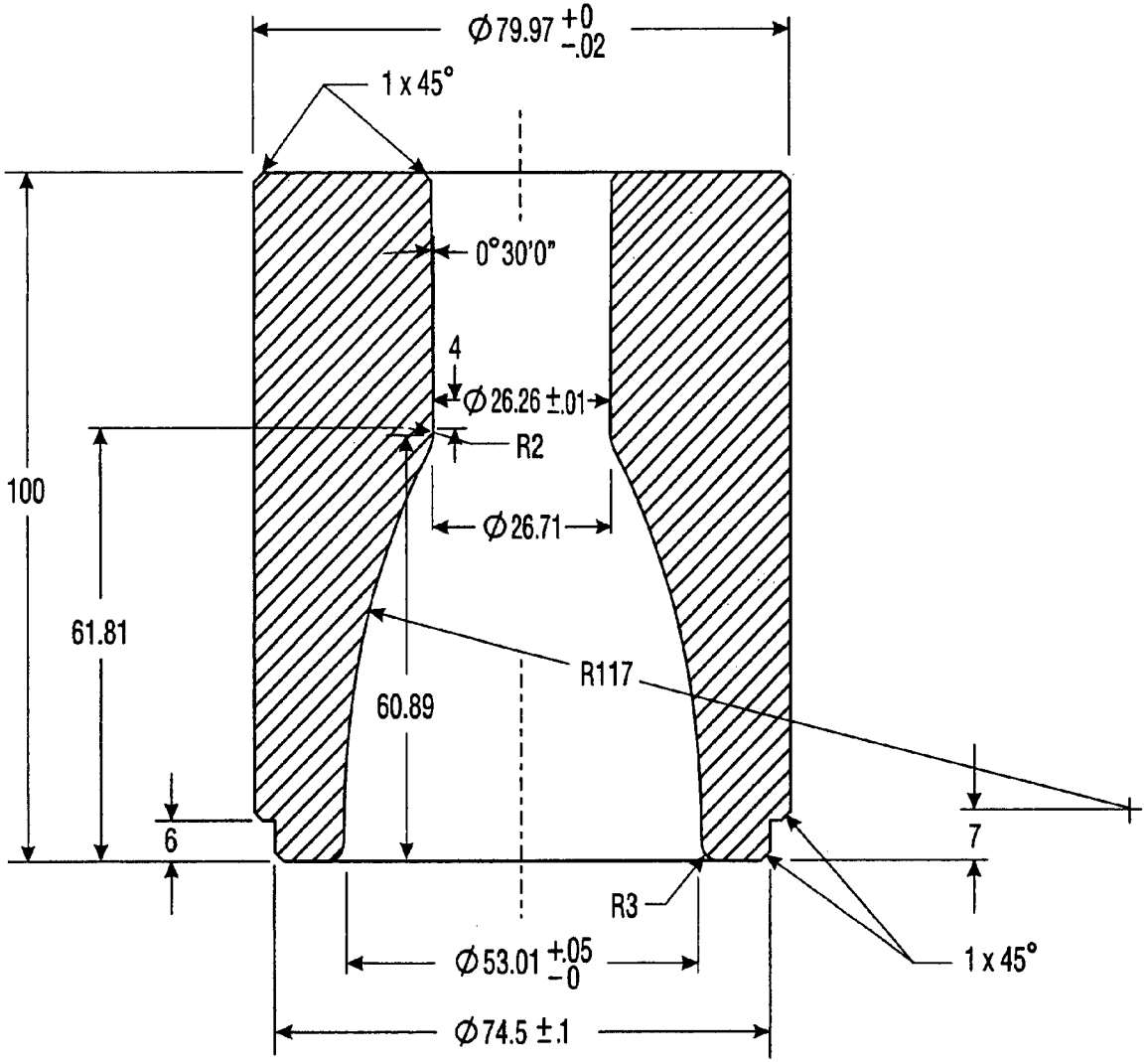
Figure 47:
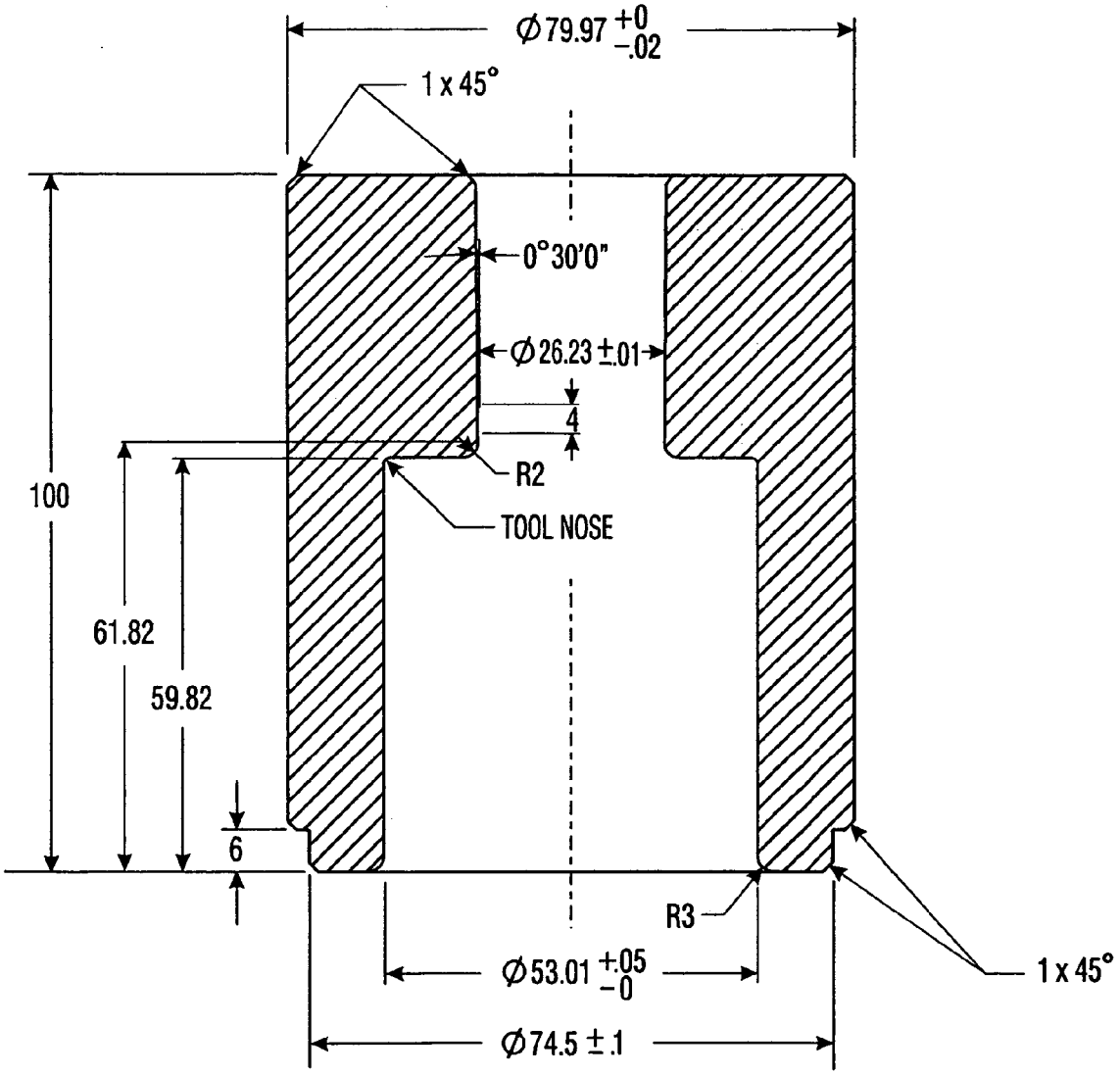
Figure 51:
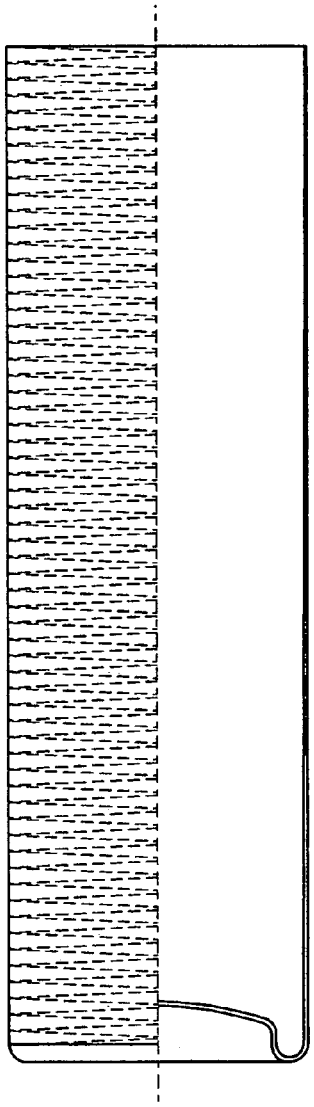
FIG. 51 shows an aluminum can of the present invention having a brushed exterior, partially in cross-section.
Figure 53:
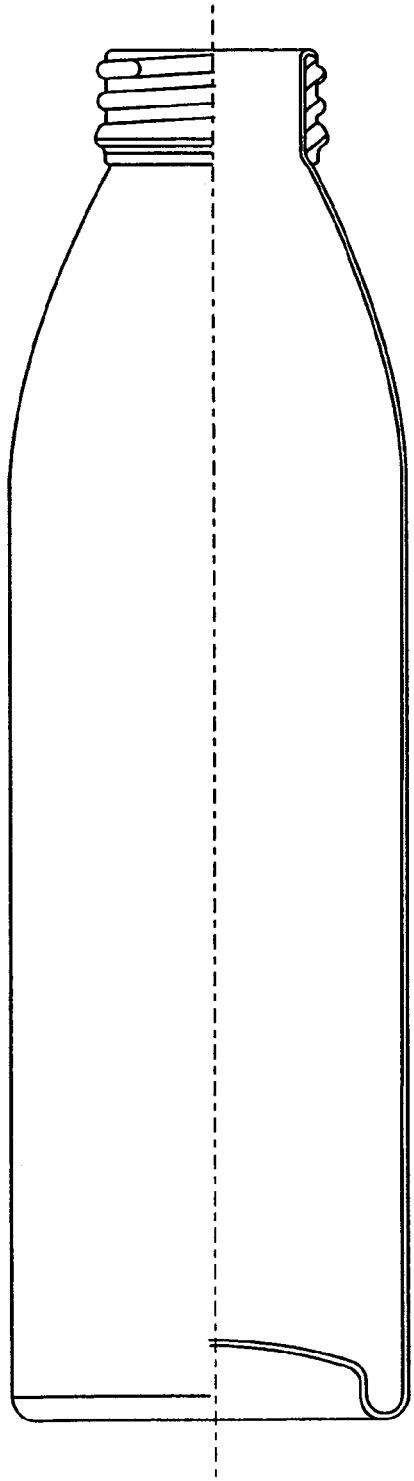
FIG. 53 shows an aluminum can of the present invention having a threaded plastic outsert over the can neck, partially in cross-section.

The can 10, partially shown in FIG. 10B, is shown in full in FIG. 11A. As shown in FIGS. 11A through 11D, the neck 19 of the can 10 is curled through a series of curling steps. The resulting aerosol can 10 of the present invention (as shown in both FIG. 11D and FIG. 1) has the predetermined shoulder profile 18, the curled neck 19, and is adapted to receive an aerosol-dispensing device. As shown in FIGS. 12A through 12D, the predetermined shoulder profile 18 can be a variety of shapes including, that of a tapered shoulder, a rounded shoulder, a flat shoulder, and an oval shoulder, respectfully. The resulting aluminum can may be between 100 and 200 mm in height and 45 and 66 mm in diameter. The aluminum can may be customized in a variety of ways. One way would be to add texture the surface of the can, for example, by brushing the surface of the can as shown in FIG. 51. Additionally, the predetermined shoulder profile can be adapted to receive an aerosol-dispensing device. The predetermined shoulder profile can also extend into or carry a neck, threaded or not (see FIGS. 52 and 53). An aluminum neck without threading can carry a threaded plastic outsert, as shown in FIG. 53.

The present invention also encompasses a method of forming a shoulder profile in an aluminum can made of a series 3000, e.g. 3004, aluminum alloy. The first step of this method entails attaching the aluminum can to a first mandrel. The can is then passed sequentially through a first series of up to and including twenty-eight necking dies that are arranged on a necking table in a circular pattern. The can is then transferred to a second mandrel. While on the second mandrel, the can is sequentially passed through a second series of up to and including twenty-eight necking dies which are arranged in a circular pattern on a second necking table. This method includes trimming the neck after the can passes through a certain predetermined number of necking dies. That is, one of the necking dies is replaced with a trimming station. Trimming eliminates excess material and irregular edges at the neck of the can and helps to prevent the can from sticking in the remaining necking dies. A sufficient number of necking dies will be used so as to effect the maximum incremental radial deformation of the can in each necking die that is possible while ensuring that the can remains easily removable from each necking die. Effecting the maximum incremental radial deformation is desirable for efficient can production. A problem arises when the deformation is too great, thus causing the can to stick inside the necking die and jam the die necking machine. Generally, at least 2° of radial deformation can be achieved with each die after the first die, which may impart less than 2° of the deformation.

Figure 48:
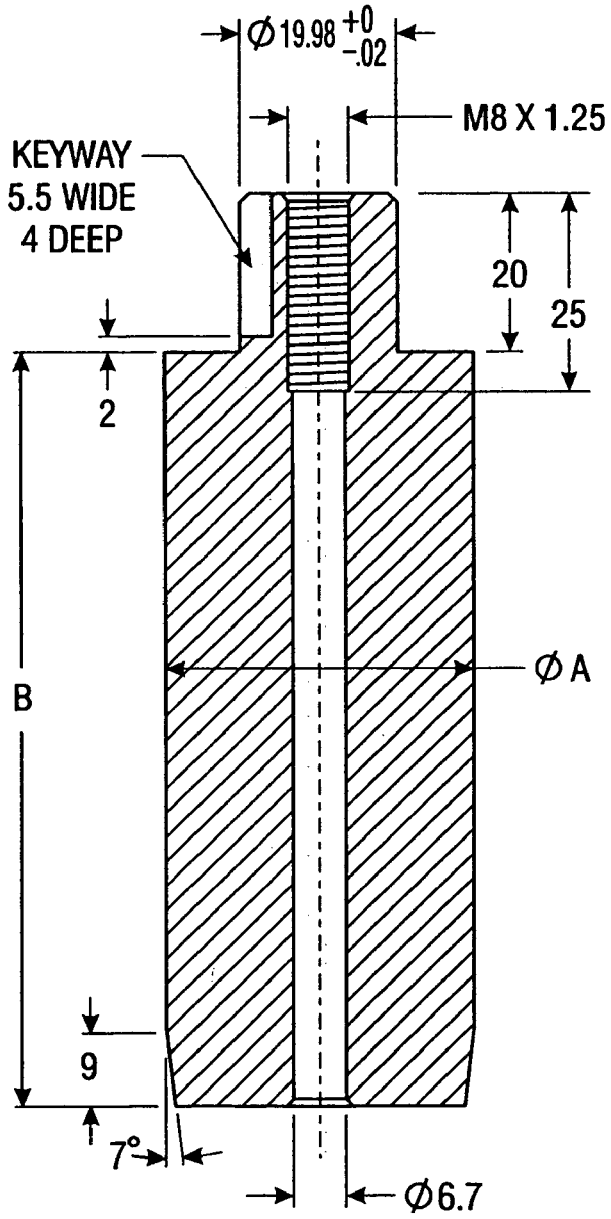
FIG. 48 shows a cross-sectional view of the center guides for the first fourteen necking dies used according to one embodiment of the present invention.
Figure 49:
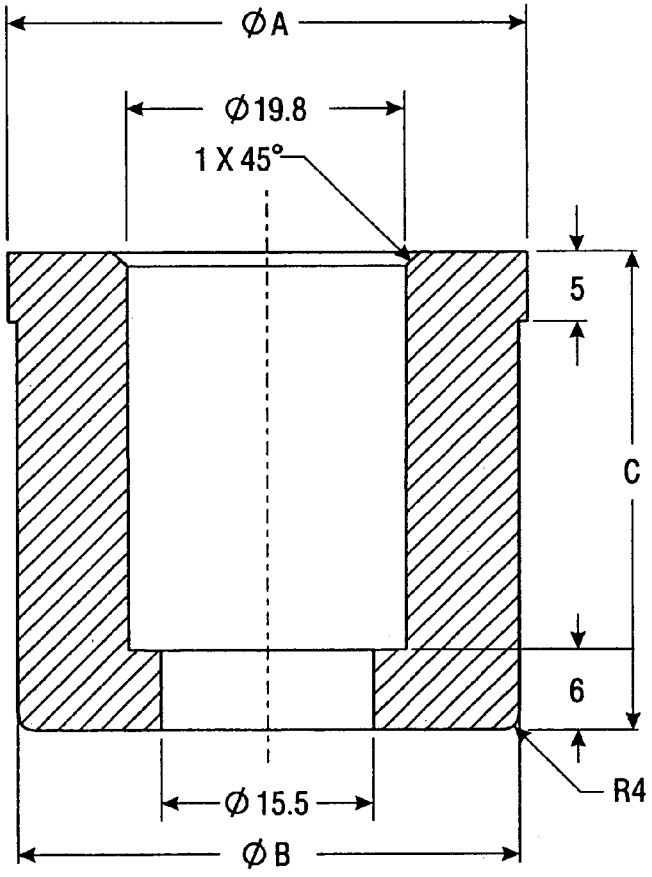
FIG. 49 shows a cross-sectional view of the center guides for necking dies number fifteen through thirty-four used for one embodiment of the present invention.
Figure 50:
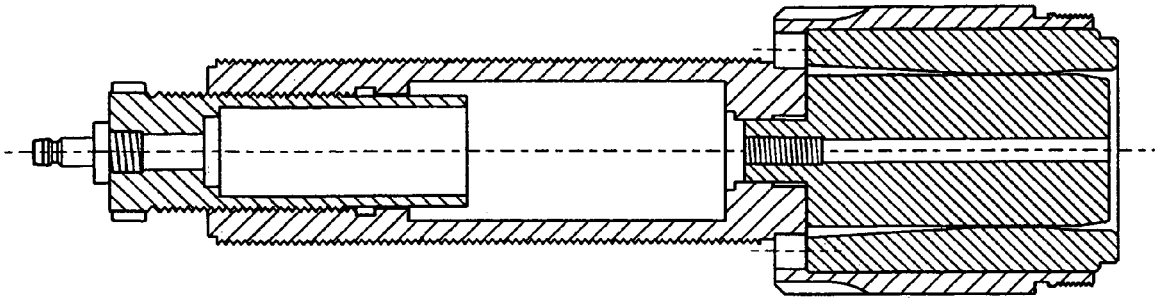
FIG. 50 illustrates one example of a die holder with a compressed air connection according to the present invention.

The shape and degree of taper imposed by each die onto the can is shown in FIGS. 13 through 47. The method of the present invention may use a stationary center guide as shown in FIG. 48 for each of the first fourteen necking dies. FIG. 49 shows the center guides for the necking dies 15 through 34. Compressed air can also be used to aid the removal of the can from the first several necking dies. For other shoulder profiles, movable guides and compressed air can be used on all necking positions. FIG. 50 shows a general die holder with a compressed air connection.

The necking dies used in the method and apparatus of the present invention differ from traditional necking dies in several ways. Each die imparts a smaller degree of deformation than the necking dies of the prior art. The angle at the back of the first necking die is 0° 30'0" (zero degrees, thirty minutes, zero seconds). The angle at the backs of dies two through six is 3° instead of the traditional 30°. The necking dies of the present invention are also longer than those traditionally used, preferably they are 100 mm in length. These changes minimize problems associated with the memory of the can walls, which memory may cause the can to stick in traditional necking dies. Additionally, in the test runs, the top of the can was pinched and was sticking on the center guide of traditional dies. Therefore, the first fourteen necking dies have non-movable center guides. Finally, the present invention uses compressed air to help force the cans off and out of each necking die. The compressed air also helps to support the can walls.

While the present invention has been described in connection with preferred embodiments thereof, those of ordinary skill in the art will recognize that many modifications and variations may be made without departing from the spirit and scope of the present invention. The present invention is not to be limited by the foregoing description, but only by the following claims.

What is claimed is:

1. A method of forming a one-piece aluminum can, comprising:

cutting a plurality of disks from a coil of series 3000 aluminum alloy approximately 0.51 mm thick;

drawing each of said disks at least once to form a cup;

reverse drawing each of said disks at least once to form a can having a bottom portion approximately 0.51 mm thick and a vertical side wall portion;

ironing said side wall portion of each can to a thickness of approximately 0.20 mm; and sequentially processing said ironed cans through a series of necking dies selected to form a shoulder and neck each having a desired profile 1 wherein said sequentially processing comprises die necking each can with a first necking die having an angle of 0°30'0" at the back of said first necking die.

2. A method of forming a one-piece aluminum can, comprising:

cutting a plurality of disks from a coil of series 3000 aluminum alloy approximately 0.51 mm thick; drawing each of said disks at least once to form a cup;

reverse drawing each of said disks at least once to form a can having a bottom portion approximately 0.51 mm thick and a vertical side wall portion;

ironing said side wall portion of each can to a thickness of approximately 0.20 mm; and sequentially processing said ironed cans through a series of necking dies selected to form a shoulder and neck each having a desired profile wherein said sequentially processing comprises die necking each can with a first necking die having an angle of 0°30'0" at the back of said first necking die and die necking each can with subsequent necking dies, at least certain of which have an angle of 3° at the back of said subsequent necking dies.

3. A method of forming a shoulder and neck in an aluminum can, comprising:

sequentially processing a can through a first series of up to 28 necking dies arranged in a first circular pattern, wherein said first series of necking dies includes a first necking die having an angle of 0°30'0"at the back of said first necking die; and sequentially processing said can through a second series of up to 28 necking dies arranged in a second circular pattern to form a desired shoulder and neck.

4. The method of claim 3 additionally comprising curling said neck of said can.

5. The method of claim 3 additionally comprising forming threads in said neck of said can.

6. The method of claim 3 additionally comprising attaching a threaded outsert onto said neck of said can.

7. The method of claim 3 wherein said desired shoulder includes one of a tapered shoulder, rounded shoulder, flat shoulder, and oval shoulder.

8. The method of claim 3 additionally comprising brushing the exterior of said can.

9. The method of claim 3 wherein said first series of necking dies includes subsequent necking dies, at least certain of which have an angle of 3° at the back of said subsequent necking dies.

10. The method of claim 3 wherein said sequentially processing a can through a first series of necking dies includes processing said can through said first series of necking dies having non-movable center guides.

11. The method of claim 10 additionally comprising using compressed air with said first series of necking dies to aid in the removal of said can from each of said dies.

12. The method of claim 3 wherein said sequentially processing said can through a first and a second series of necking dies includes passing said can through a first and a second series of necking dies each having an internal length of at least 100 mm.

13. The method of claim 3 additionally comprising trimming the neck of said can after said can passes through a predetermined one of said necking dies in said first series.

14. A method of forming the top of an aluminum can, comprising:

sequentially processing a can through a series of necking dies selected to form a neck and shoulder each having a desired profile, said necking dies having an angle of between 0°30'0" and 3° at the back of said necking dies.

15. The method of claim 14 additionally comprising curling said neck of said can.

16. The method of claim 14 additionally comprising forming threads in said neck of said can.

17. The method of claim 14 additionally comprising attaching a threaded outsert onto said neck of said can.

18. The method of claim 14 wherein said desired shoulder profile includes one of a tapered shoulder, rounded shoulder, flat shoulder, and oval shoulder.

19. The method of claim 14 additionally comprising brushing the exterior of said can.

20. The method of claim 14 wherein said series of necking dies includes a total of at least thirty different necking dies.

21. The method of claim 14 wherein said sequentially processing a can includes processing said can through a series of necking dies in which the first fourteen necking dies having non-movable center guides.

22. The method of claim 21 additionally comprises using compressed air with said first fourteen dies to aid in the removal of said can from each of said dies.

23. The method of claim 14 wherein said sequentially processing said can includes processing said can through a series of necking dies each having an internal length of at least 100 mm.

24. The method of claim 14 additionally comprising trimming the neck of said can after said can passes through a predetermined one of said necking dies.

* * * * *

UNITED STATES PATENT AND TRADEMARK OFFICE

CERTIFICATE OF CORRECTION

PATENT NO. : 7,140,223 B2
APPLICATION NO. : 11/151385
DATED : November 28, 2006
INVENTOR(S) : Thomas Chupak It is certified that error appears in the above-identified patent and that said Letters Patent is hereby corrected as shown below:

Column 1, line 23, delete “seem” and insert therefore -- seam -- .
Column 5, line 37, after “texture” insert therefore -- to -- .

Claim 1, Column 6, line 54, delete “1”.

Signed and Sealed this

Nineteenth Day of June, 2007

JON W. DUDAS
*Director of the United States Patent and Trademark Office*